US008894075B2

(12) United States Patent
Walker

(10) Patent No.: US 8,894,075 B2
(45) **Date of Patent: *Nov. 25, 2014**

(54) BOARD SPORT BINDINGS

(76) Inventor: Brendan Walker, New York, NY (US)

( * ) Notice: Subject to any disclaimer, the term of this patent is extended or adjusted under 35 U.S.C. 154(b) by 176 days.

This patent is subject to a terminal disclaimer.

(21) Appl. No.: 13/360,309

(22) Filed: Jan. 27, 2012

(65) Prior Publication Data

US 2012/0211969 A1 Aug. 23, 2012

Related U.S. Application Data

(63) Continuation-in-part of application No. 12/554,713, filed on Sep. 4, 2009, now Pat. No. 8,276,921.

(60) Provisional application No. 61/436,820, filed on Jan. 27, 2011.

(51) Int. Cl.

| | |
|---|---|
| ***A63C 9/00*** | (2012.01) |
| ***A63C 10/14*** | (2012.01) |
| *A63C 10/24* | (2012.01) |
| *A63C 10/06* | (2012.01) |
| *A63C 10/18* | (2012.01) |

(52) U.S. Cl.

CPC ..... *A63C 10/145* (2013.01); *A63C 10/24* (2013.01); *A63C 10/06* (2013.01); *A63C 10/18* (2013.01)

USPC ..... 280/14.24; 280/612; 280/618

(58) Field of Classification Search

CPC ..... A63C 10/18

USPC ..... 280/306, 11.14, 11.15, 11.3–11.36, 280/612, 613

See application file for complete search history.

(56) References Cited

U.S. PATENT DOCUMENTS

| | | | | |
|---|---|---|---|---|
| 3,353,835 | A | 11/1967 | Sommer | |
| 3,667,771 | A * | 6/1972 | Larson | 280/612 |
| 3,687,471 | A | 8/1972 | Sommer | |
| 3,927,897 | A | 12/1975 | Olson et al. | |
| 4,196,920 | A | 4/1980 | Salomon | |
| 4,316,618 | A * | 2/1982 | Sampson | 280/613 |
| 4,652,007 | A | 3/1987 | Dennis | |
| 4,741,550 | A | 5/1988 | Dennis | |

(Continued)

FOREIGN PATENT DOCUMENTS

| | | |
|---|---|---|
| CN | 1519045 | 8/2004 |
| CN | 1750859 | 3/2006 |

(Continued)

OTHER PUBLICATIONS

Chinese Office Action on 201080002556.4 dated Nov. 5, 2013.

(Continued)

*Primary Examiner* — J. Allen Shriver, II
*Assistant Examiner* — Jacob Meyer
(74) *Attorney, Agent, or Firm* — Foley & Lardner LLP; John D. Lanza

(57) ABSTRACT

A binding for board sports has at least a portion of a first layer of a surface. At least a portion of a second layer is configured to dock with the first layer. A locking mechanism is configured to prevent the second layer from undocking with the first layer in response to the second layer moving in a first direction when the first layer is docked with the second layer.

16 Claims, 21 Drawing Sheets

(56) References Cited

U.S. PATENT DOCUMENTS

| | | | | | |
|---|---|---|---|---|---|
| 4,973,073 | A | * | 11/1990 | Raines et al. | 280/624 |
| RE33,544 | E | | 2/1991 | Dennis | |
| 5,028,068 | A | | 7/1991 | Donovan | |
| 5,035,443 | A | * | 7/1991 | Kincheloe | 280/618 |
| 5,261,689 | A | | 11/1993 | Carpenter | |
| 5,354,088 | A | | 10/1994 | Vetter et al. | |
| 5,362,087 | A | | 11/1994 | Agid | |
| 5,474,322 | A | * | 12/1995 | Perkins et al. | 280/613 |
| 5,499,837 | A | | 3/1996 | Hale et al. | |
| 5,505,478 | A | | 4/1996 | Napoliello | |
| 5,520,405 | A | * | 5/1996 | Bourke | 280/613 |
| 5,520,406 | A | * | 5/1996 | Anderson et al. | 280/624 |
| 5,553,883 | A | | 9/1996 | Erb | |
| 5,695,210 | A | | 12/1997 | Goss et al. | |
| 5,743,550 | A | | 4/1998 | Frohwein | |
| 5,762,358 | A | | 6/1998 | Hale | |
| 5,906,388 | A | * | 5/1999 | Neiley | 280/613 |
| 5,913,530 | A | | 6/1999 | Berger et al. | |
| 5,941,552 | A | | 8/1999 | Beran | |
| 5,954,357 | A | | 9/1999 | Golling | |
| 5,967,542 | A | | 10/1999 | Williams et al. | |
| 6,022,040 | A | | 2/2000 | Buzbee | |
| 6,135,486 | A | | 10/2000 | Neiley | |
| 6,189,899 | B1 | | 2/2001 | Carlson | |
| 6,189,913 | B1 | | 2/2001 | Morrow et al. | |
| 6,206,403 | B1 | | 3/2001 | Black et al. | |
| 6,224,086 | B1 | | 5/2001 | Golling | |
| 6,227,552 | B1 | | 5/2001 | Keller et al. | |
| 6,290,243 | B1 | | 9/2001 | Beran | |
| 6,299,192 | B1 | | 10/2001 | Bryce | |
| 6,315,305 | B1 | | 11/2001 | Gien | |
| 6,499,757 | B1 | * | 12/2002 | Berger et al. | 280/607 |
| 6,557,866 | B2 | | 5/2003 | Jones et al. | |
| 6,575,489 | B1 | | 6/2003 | White | |
| 6,616,151 | B1 | | 9/2003 | Golling | |
| 6,626,443 | B2 | * | 9/2003 | Lafond | 280/14.24 |
| 6,705,633 | B2 | | 3/2004 | Poscich | |
| 6,722,688 | B2 | | 4/2004 | Poscich | |
| 6,726,238 | B2 | | 4/2004 | Poscich | |
| 6,983,952 | B2 | | 1/2006 | Golling | |
| 7,059,614 | B2 | | 6/2006 | Cole, III | |
| 7,220,158 | B1 | | 5/2007 | Norris | |
| 7,267,357 | B2 | | 9/2007 | Miller et al. | |
| 7,270,337 | B1 | * | 9/2007 | Carotenuto | 280/14.24 |
| 7,281,717 | B2 | | 10/2007 | Sacco et al. | |
| 7,296,805 | B2 | | 11/2007 | Lindemann | |
| 7,338,067 | B2 | | 3/2008 | Flaig | |
| 7,416,191 | B2 | | 8/2008 | Yoshino | |
| 7,658,398 | B2 | | 2/2010 | Panzeri | |
| 7,823,300 | B2 | | 11/2010 | Fullerton et al. | |
| 7,918,477 | B2 | * | 4/2011 | Wischhusen et al. | 280/618 |
| 8,065,819 | B2 | | 11/2011 | Kaufman | |
| 2003/0047910 | A1 | | 3/2003 | Golling | |
| 2003/0075890 | A1 | | 4/2003 | Jacobs | |
| 2003/0094788 | A1 | | 5/2003 | Jacobs | |
| 2003/0164599 | A1 | | 9/2003 | Golling | |
| 2003/0164605 | A1 | | 9/2003 | Maravetz et al. | |
| 2007/0090627 | A1 | | 4/2007 | Laurent | |
| 2010/0253021 | A1 | | 10/2010 | Kostantin | |
| 2011/0057420 | A1 | | 3/2011 | Walker | |

FOREIGN PATENT DOCUMENTS

| | | | |
|---|---|---|---|
| EP | 1709999 | A1 | 10/2006 |
| FR | 2851173 | A1 | 8/2004 |
| JP | 10314365 | A | 12/1998 |
| WO | 2005092454 | A1 | 10/2005 |

OTHER PUBLICATIONS

International Preliminary Report on Patentability received in PCT/US2010/047134 mailed Mar. 15, 2012, 9 pgs.

International Search Report and Written Opinion of the International Searching Authority received in PCT/US2010/047134 mailed Oct. 26, 2010, 11 pgs.

Supplementary European Search Report EP 10 81 3095.6 mailed Jan. 11, 2012, 8 pgs.

English Abstract of French Abstract for FR2851173, 1 pg, Aug. 20, 2004.

English Abstract of Japanese Abstract for JP10314365. 1 pg, Dec. 2, 1998.

International Search Report and Written Opinion of the International Searching Authority received in PCT/US2012/022976 mailed May 10, 2012, 8 pgs.

* cited by examiner

BOARD SPORT BINDINGS

RELATED CASES

This application claims the benefit of U.S. Provisional Application No. 61/436,820, filed on Jan. 27, 2011, by Walker, entitled BINDING FOR SNOWBOARD AND OTHER BOARD SPORTS, the contents of which are all incorporated by reference.

This application is a continuation-in-part of U.S. patent application Ser. No. 12/554,713 filed Sep. 4, 2009 by Walker, entitled SNOWBOARD BINDING, now published as U.S. Patent Application Publication No. 2011/0057420 on Mar. 10, 2011, the contents of which are all incorporated by reference.

BACKGROUND

When riding a board, e.g., a snowboard, each of the user's feet/boots may be secured to the snowboard, for example, with an apparatus called a "binding." The bindings may keep the user and snowboard from separating during the ride. Bindings are also commonly configured to transfer forces from the user to the snowboard, allowing the user to control the snowboard during the ride.

One type of binding for use with, e.g., a snowboard, may be referred to as a "strap-in" binding. The strap-in binding may be designed to receive a boot, such as, for example, the type of boot that may be referred to in the art as a "soft boot." A strap-in binding may incorporate one or more adjustable straps, which, when tightened, may push the user's boot against the relatively rigid interior surface(s) of the binding. The pressure of the straps and the interior surfaces may hold the boot in the binding while the snowboard is in use and help the user to control the snowboard.

Another type of binding may be referred to in the art as a "step-in" binding. A step-in binding may incorporate a relatively flat base that may include a mechanism that connects to hinges, fixtures, and/or other mechanisms on the bottom of the user's boot. A boot for use with a step-in binding is typically more rigid and sturdy than one typically used with a strap-in binding, and the rigid structures of the boot may transmit forces exerted by the user to the snowboard, helping the user to control it. The construction that makes a boot suitable for use with a step-in binding may also make the boot heavier than a soft boot, as may the hardware built into the boot that is needed to secure the boot to the snowboard.

Inconveniences attend use of either of the strap-in binding and the step-in binding. For example, securing a boot inside a strap-in binding commonly requires that the user's hands be available to tighten the straps. A common consequence is that a snowboard user cannot ride directly off of a ski lift and onto a slope, as skiers may do, because the user typically must first get off of the ski lift and then secure at least one boot to the appropriate binding.

Step-in bindings, as mentioned above, commonly entail using boots that may be heavier and stiffer than the soft boots that may typically be used with a strap-in binding. The weight and rigidity may make such boots less comfortable to wear than soft boots, and experienced snowboard users may feel that the weight and rigidity compromise the user's control of the snowboard during a ride.

BRIEF SUMMARY OF THE DISCLOSURE

In one implementation, an apparatus for board sport bindings comprises a first layer of a surface. At least a portion of a second layer is configured to dock the second layer with the first layer. A locking mechanism is configured to prevent the second layer from undocking with the first layer in response to the second layer moving in a first direction when the first layer is docked with the second layer.

One or more of the following features may be included. The first layer may include at least a portion of a board base. The surface may include at least a portion of a board. The board may include at least one of a snowboard, a kiteboard, and a wakeboard. The second layer may include a binding base. The second layer may include a boot. At least one of the first layer and the second layer may include one or more magnets configured to dock the second layer to the first layer via the one or more magnets. The second layer may include an intermediate adapter plate configured to fixably attach to at least one of a board base, a board deck, and a binding base. The locking mechanism may include one or more lips and one or more shelves. The locking mechanism may include one or more cams and one or more nubs. The first direction may include at least one of a forward direction, a backward direction, a left direction, a right direction, a diagonal direction, and a rotating direction around an axis perpendicular to the first layer.

In another implementation, an apparatus for board sport bindings comprises a first layer configured to attach to a surface and a second layer configured to dock with the first layer. The apparatus also includes a means for docking the first layer to the second layer. The apparatus also includes a means for preventing the second layer from undocking with the first layer in response to the second layer moving in a first direction when the first layer is docked with the second layer.

One or more of the following features may be included. The first layer may include at least a portion of a board base. The surface may include at least a portion of a board. The board may include at least one of a snowboard, a kiteboard, and a wakeboard. The second layer may include a binding base. The second layer may include a boot. At least one of the first layer and the second layer may include one or more magnets configured to dock the second layer to the first layer via the one or more magnets. The second layer may include an intermediate adapter plate configured to fixably attach to at least one of a board base, a board deck, and a binding base. The means for preventing may be a locking mechanism that may include one or more lips and one or more shelves. The means for preventing may be a locking mechanism that may include one or more cams and one or more nubs. The first direction may include at least one of a forward direction, a backward direction, a left direction, a right direction, a diagonal direction, and a rotating direction around an axis perpendicular to the first layer.

DETAILED DESCRIPTION OF PREFERRED EMBODIMENTS

As will be discussed in greater detail below with regard to FIGS. 1-26, according to an embodiment of the disclosure, an apparatus for board sport binding(s) may comprise an apparatus for board sport bindings that comprises a first layer of a surface. At least a portion of a second layer may be configured to dock the second layer with the first layer. A locking mechanism may be configured to prevent the second layer from undocking with the first layer in response to the second layer moving in a first direction when the first layer is docked with the second layer.

Alternatively/additionally, the first layer may include at least a portion of a board base. The surface may include at least a portion of a board. The board may include at least one of a snowboard, a kiteboard, and a wakeboard. The second layer may include a binding base. The second layer may include a boot. At least one of the first layer and the second layer may include one or more magnets configured to dock the second layer to the first layer via the one or more magnets. The second layer may include an intermediate adapter plate configured to fixably attach to at least one of a board base, a board deck, and a binding base. The locking mechanism may include one or more lips and one or more shelves. The locking mechanism may include one or more cams and one or more nubs. The first direction may include at least one of a forward direction, a backward direction, a left direction, a right direction, a diagonal direction, and a rotating direction around an axis perpendicular to the first layer.

Figure 1:
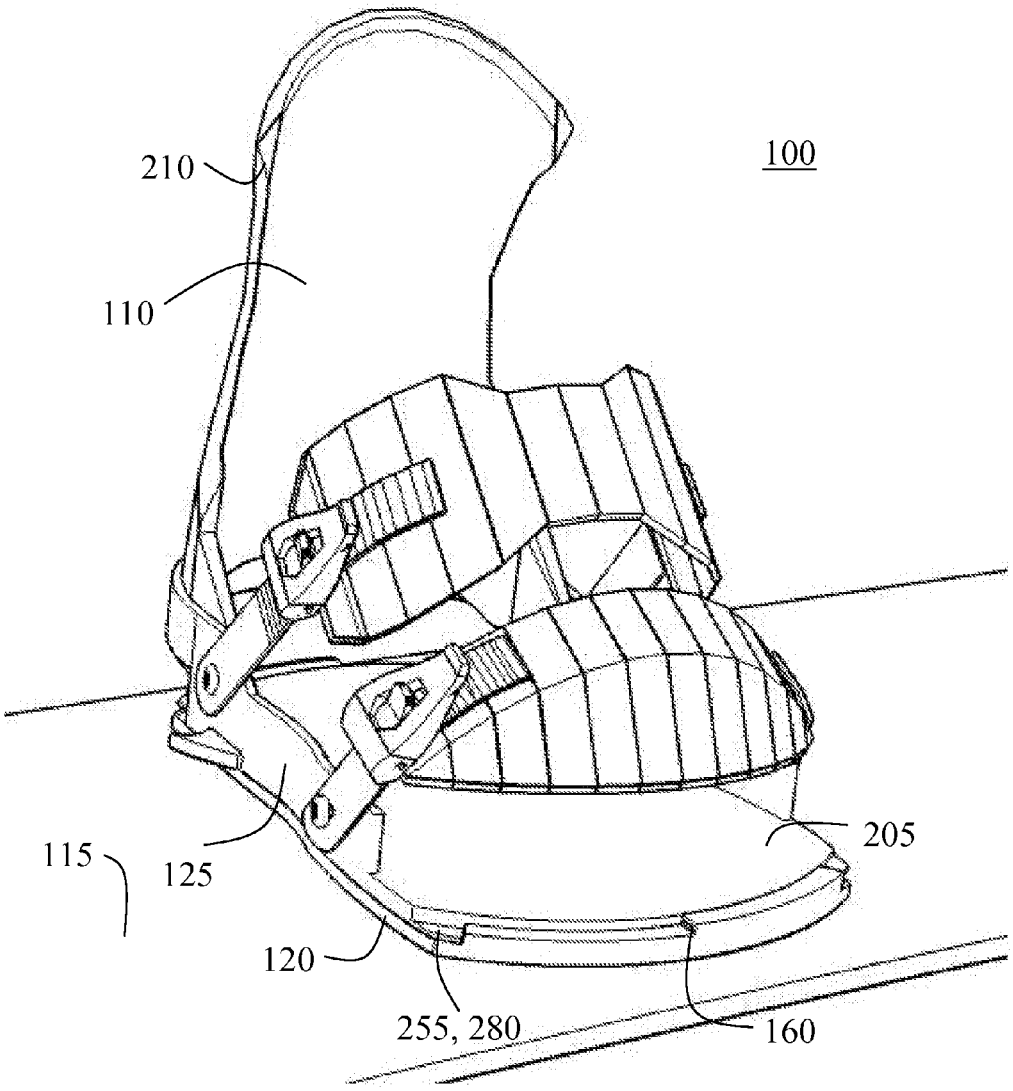
FIG. 1 depicts a binding affixed to a snowboard deck according to an embodiment of the disclosure.

FIG. 1 depicts an assembly 100 that may comprise a board binding (e.g., snowboard binding 110) affixed to at least a portion of a surface, such as a board deck (e.g., snowboard deck 115) according to an embodiment of the disclosure. As depicted, two cooperating components may comprise a board base (e.g., snowboard base/first layer 120), mounted atop a board deck (e.g., snowboard deck 115), and a binding base (e.g., snowboard binding base/second layer 125). As used herein, the term binding base and second layer may be used interchangeably. Board base/first layer 120 and binding base 125 are depicted in a locked configuration, such as for use, according to an embodiment of the disclosure.

While one or more embodiments of the disclosure are described in terms of, for example, a snowboard, those skilled in the art will appreciate that any other board sport types, such as kiteboarding, wakeboarding, etc., may also be used without departing from the scope of the disclosure. As such, the specific description of a snowboard should be taken as an example only and not to otherwise limit the scope of the disclosure.

"Use" of a snowboard herein is meant in ordinary senses of the word. Just as in ordinary use of the term, depending on the context, a snowboard may be considered to be in use while the user is riding it down a slope, or while the user is secured to it, e.g., by one or more bindings according to an embodiment of the disclosure, or during a snowboarding session, which may comprise one or more rides down one or more slopes. The sense in which any particular instance of the term is meant herein may be determined from the context.

Figure 2:
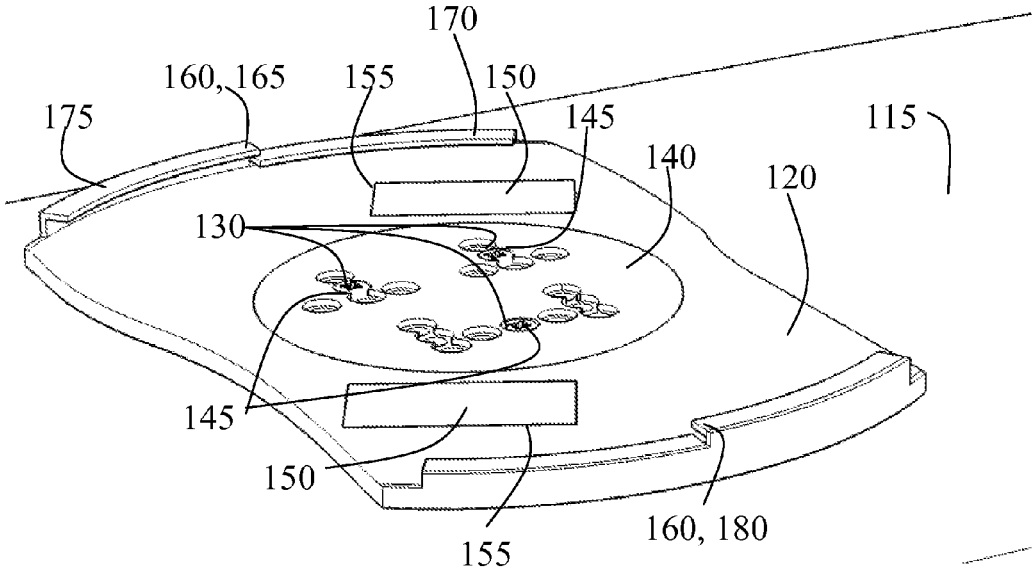
FIG. 2 depicts a board base, viewed from the heel side and affixed to a snowboard according to an embodiment of the disclosure.

FIG. 2 depicts board base/first layer 120, according to an embodiment of the disclosure, which may be permanently held to the top of snowboard deck 115. ("Permanent" is used here in a broad, contextual sense, to refer to a feature or configuration that is not normally altered during ordinary use of an embodiment of the disclosure. Depending on the embodiment of the disclosure, a feature or configuration referred to herein as permanent may or may not be alterable without causing damage to assembly 100 or any one or more parts of it, and, if alterable, making such alteration may or may not involve appropriate tools.)

Methods of securing board base/first layer 120 to snowboard deck 115 include methods that are well known in the art. For example, snowboard deck 115 may be manufactured to incorporate threaded metal inserts (not shown). Board base 120 in an embodiment of the disclosure may be fastened, e.g., directly to snowboard deck 115 by one or more fasteners 130 such as, for example, threaded bolts, screws, or studs, that pass, e.g., through one or more holes in board base/first layer 120 into the threaded inserts in the base.

Figure 3:
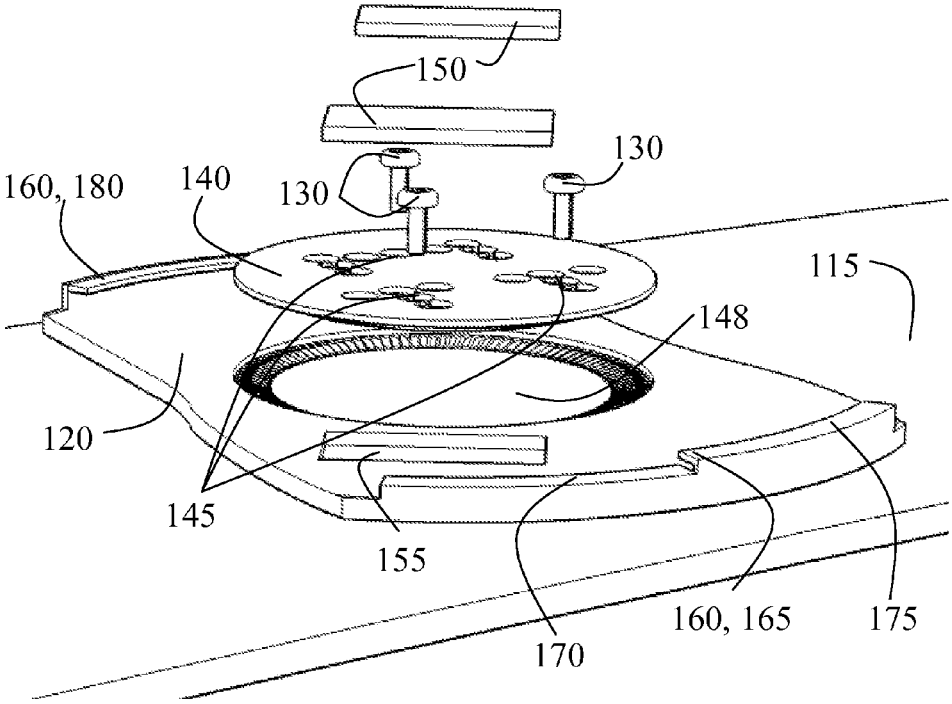
FIG. 3 is an exploded view of board base, viewed from the toe side, and a snowboard deck according to an embodiment of the disclosure.

In an embodiment of the disclosure, such as FIG. 2 and/or FIG. 3, board base/first layer 120 is not directly affixed to snowboard deck 115, but is held firmly against snowboard deck 115 and prevented from rotating by adjusting disk 140, e.g., as is known in the art. Adjusting disk 140 is in turn removably affixed to snowboard deck 115 by threaded fasteners 130 that pass through respective holes 145 in adjusting disk 140.

Figure 4:
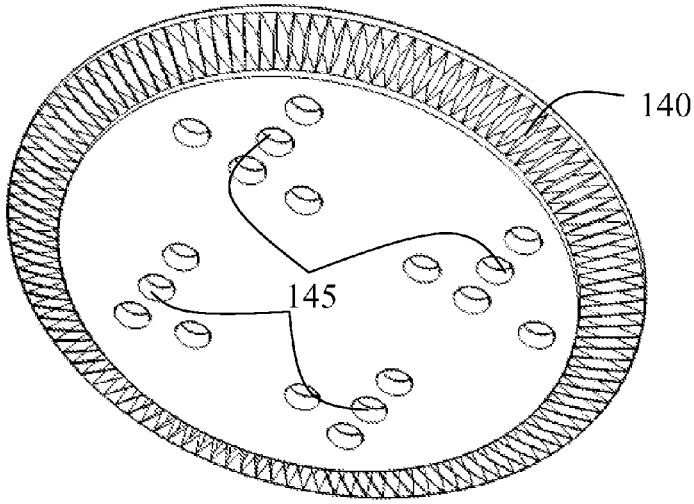
FIG. 4 depicts the underside of an adjusting disk according to an embodiment of the disclosure.

FIG. 3 provides an exploded view of one or more components depicted in FIG. 2. In an embodiment of the disclosure, board base/first layer 120 may include circular hole or cutout 148. In an embodiment of the disclosure, such as FIGS. 2 and 3, the rim of the underside of adjusting disk 140 and the rim of hole 148 may comprise corresponding evenly-spaced ridges or other shapes. FIG. 4 depicts the underside of adjusting disk 140, according to an embodiment of the disclosure, illustrating the ridges that may interlock with corresponding ridges in snowboard base/first layer 120.

Returning to FIGS. 2 and 3, tightening fasteners 130, in an embodiment of the disclosure, may cause adjusting disk 140 to press board base/first layer 120 against snowboard deck 115. In an embodiment of the disclosure, the alignment of board base/first layer 120 relative to snowboard deck 115 may be set, e.g., when board base/first layer 120 is secured to snowboard deck 115. The pressure exerted by the adjusting disk may hold board base/first layer 120 firmly and securely to snowboard deck 115, and the interlocking ridges in adjusting disk 140 and board base/first layer 120 may inhibit rotation of board base/first layer 120 relative to snowboard deck 115. If desired, in an embodiment of the disclosure, the alignment of board base/first layer 120 relative to snowboard deck 115 may be adjusted by loosening fasteners 130, rotating board base/first layer 120 into a desired alignment, and then tightening fasteners 130.

In an embodiment of the disclosure, the dimensions of board base/first layer 120 and adjusting disk 140 may be such that, e.g., when fasteners 130 are fully tightened, the bottom of adjusting disk 140 is flush with the bottom of board base/first layer 120. Similarly, the top of adjusting disk 140 may be flush with the top of board base/first layer 120. Further, in an embodiment of the disclosure, some or all of holes 145 in adjusting disk 140 may be, e.g., countersunk or counterbored at the top, causing the tops of some or all of fasteners 130 to be flush with the top of adjusting disk 140 or below it when the fasteners are fully tightened.

Board base 120 in an embodiment of the disclosure may comprise one or more permanent magnets 150. For example, in the embodiment of the disclosure depicted in FIGS. 2 and 3, board base/first layer 120 may comprise two cutouts 155, each with a flanged rim that is sufficient in extent and strength to retain one of the magnets 150 in the respective cutout 155 despite attraction between the magnet and any outside objects. In an embodiment of the disclosure, one or more of magnets 150 may be, e.g., partially covered by, or encased in, a material such as nickel or plastic to protect and/or to improve the durability of magnet 150.

Instead of or in addition to the foregoing, in an embodiment of the disclosure, one or more of magnets 150 may be glued or otherwise fixed to the body of board base/first layer 120. In an embodiment of the disclosure, one or more of permanent magnets 150 may be embedded in the material of board base/first layer 120. Instead of or in addition to fixing one or more of magnets 150 to board base/first layer 120, in an embodiment of the disclosure, one or more of the magnets 150 may be fixed to snowboard deck 115 in a manner capable of exerting suitable attractive and/or repulsive forces on an object above but relatively near to board base/first layer 120.

Those skilled in the art will recognize that any particular placement of any magnet on/within any specific location of the board and/or binding (e.g., snowboard deck 115, board base/first layer 120, or any other components described herein) should be taken as an example only and not to otherwise limit the scope of the disclosure. For instance, it is contemplated that magnets 150 may be placed, at least in part, on or inside a foot covering (e.g., a snowboarding boot) to achieve the same or similar functionality as placing magnets 150 on/within snowboard deck 115 and/or board base/first layer 120. This may be accomplished, for example, with magnets 150 incorporated on/within a boot during the manufacture of the boot, and/or post manufacture. Those skilled in the art will appreciate that the boot may be considered (either whole or in part) as the second layer described throughout as appropriate.

It will also be appreciated by one skilled in the relevant arts that other suitable ways exist to incorporate one or more magnets in the board base/first layer 120, in addition to or instead of one or more of the foregoing, in embodiments of the disclosure. For example, in an embodiment of the disclosure such as FIGS. 2 and 3 depict, no portion of either magnet 150 protrudes from the upper surface of board base/first layer 120.

In an embodiment of the disclosure, board base/first layer 120 may comprise two separate sets of shelves 160, which may project perpendicularly away from snowboard deck 115. In an embodiment of the disclosure, each shelf 160 may describe, e.g., a portion of a hypothetical circle such that all shelves 160 describe respective portions of the same hypothetical circle.

One set of shelves 160 ("toe side shelves" 165) may be, e.g., on the edge of board base/first layer 120 nearest the user's toes. In an embodiment of the disclosure, toe side shelves 165 may comprise, e.g., two shelves. In such an embodiment, one of the toe side shelves 170 may be, e.g., 1/16 of an inch from the surface of board base/first layer 120, and the other 175 may be, e.g., 3/16 of an inch from the surface of board base/first layer 120. The same or similar dimensions may be used, e.g., for the two depicted heel-side shelves 180.

The width of shelves 160 may vary depending, e.g., on the strength and flexibility of the material or materials used and the manner of construction; for example, in the depicted embodiment of the disclosure, shelves 160 are ¼ inch wide. In the depicted embodiment of the disclosure, all shelves 160 are the same thickness and width, but, in an embodiment of the disclosure, one or more of shelves 160 may differ in thickness, width, or both from one or more other shelves 160. As such, any specific dimensions described throughout should be taken as an example only and not to otherwise limit the scope of the disclosure.

Some or all of shelves 160 may, in an embodiment of the disclosure, such as FIGS. 2 and 3, be made, e.g., as integral parts of board base/first layer 120 or as distinct parts, that may be affixed directly or indirectly to board base/first layer 120, e.g., during manufacture.

Returning to FIG. 1, snowboard binding 110 according to an embodiment of the disclosure may comprise binding base 125. Binding base 125 is, in an embodiment of the disclosure, configured to receive and retain a boot, which may be worn by the user while the snowboard is in use. For example, binding base 125 may in an embodiment of the disclosure be configured, e.g., in a manner similar to that of a strap-in binding, such as described above, to receive a soft boot and to secure it in place with one or more adjustable straps that are capable of holding the boot against base 205 of binding base 125 and highback 210.

As described in more detail below, binding base 125 is in the depicted embodiment of the disclosure configured to dock with board base/first layer 120, e.g., guided and/or otherwise assisted by magnetic forces. In the depicted embodiment, once docked, structures of the binding base 125 may be engaged with structures of the board base/first layer 120 to hold the bases together, and, while engaged, the bases may be secured to one another in a configuration suitable for use. A locking mechanism may hold the bases in an engaged and secured configuration until manually released.

Figure 5:
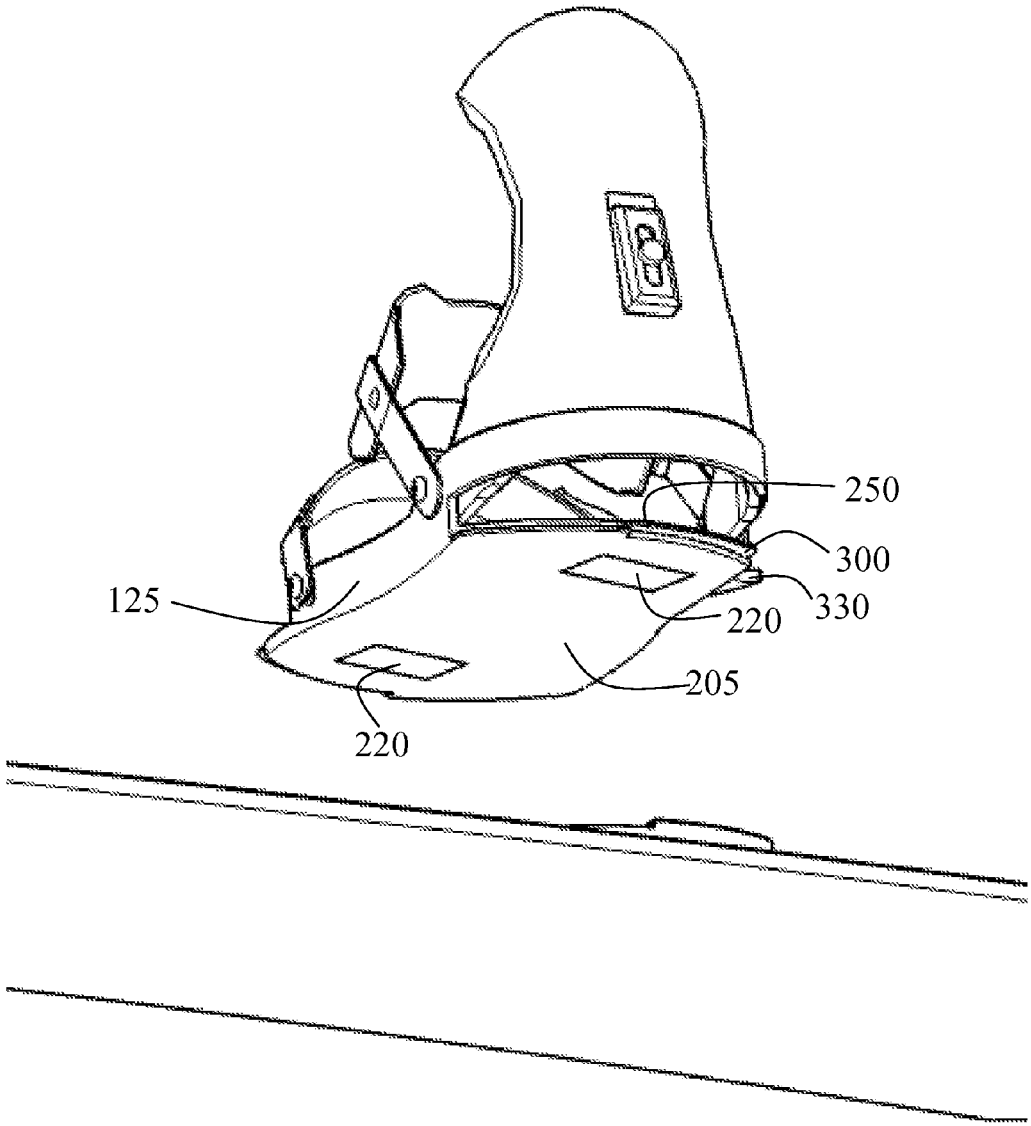
FIG. 5 depicts a binding base according to an embodiment of the disclosure.
Figure 6:
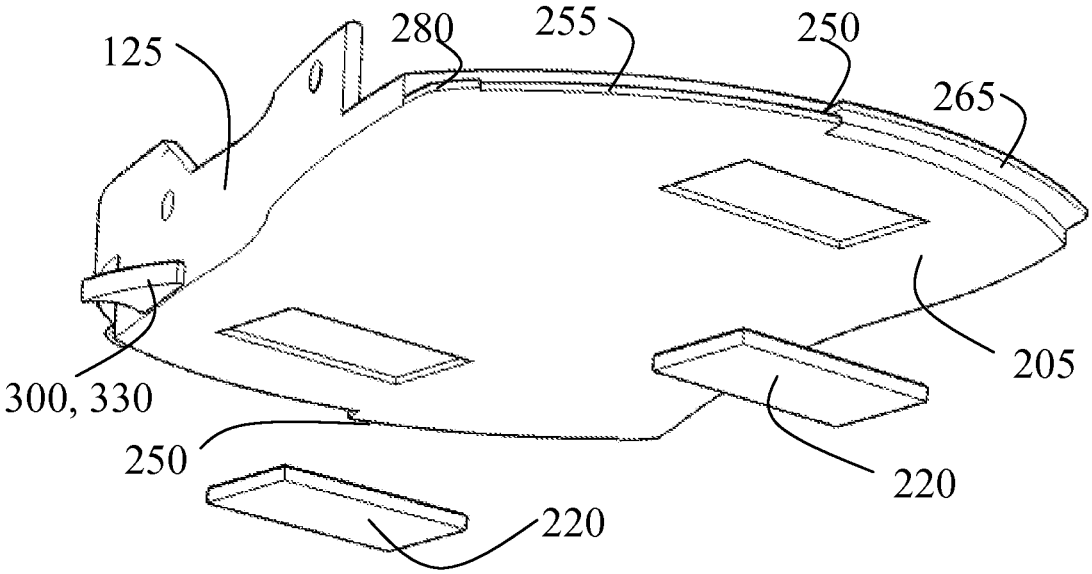
FIG. 6 is a partial exploded view of the underside of a binding base according to an embodiment of the disclosure.

As FIG. 5 and FIG. 6 depict, in an embodiment of the disclosure, base 205 of binding base 125 may contain one or more permanent magnets 220. One or more of magnets 220 may be affixed to and/or embedded in base 205, e.g., as one or more of magnets 150 discussed previously may be affixed to and/or embedded in board base/first layer 120. In an embodiment of the disclosure, one or more of magnets 220 may be, e.g., partially covered by, or encased in, a material such as nickel or plastic to protect and/or to improve the durability of magnet 220. Further, in an embodiment of the disclosure such as FIGS. 5 and 6, no part of either magnet 220 protrudes from the lower surface of base 205 of binding base 125.

Figure 7:
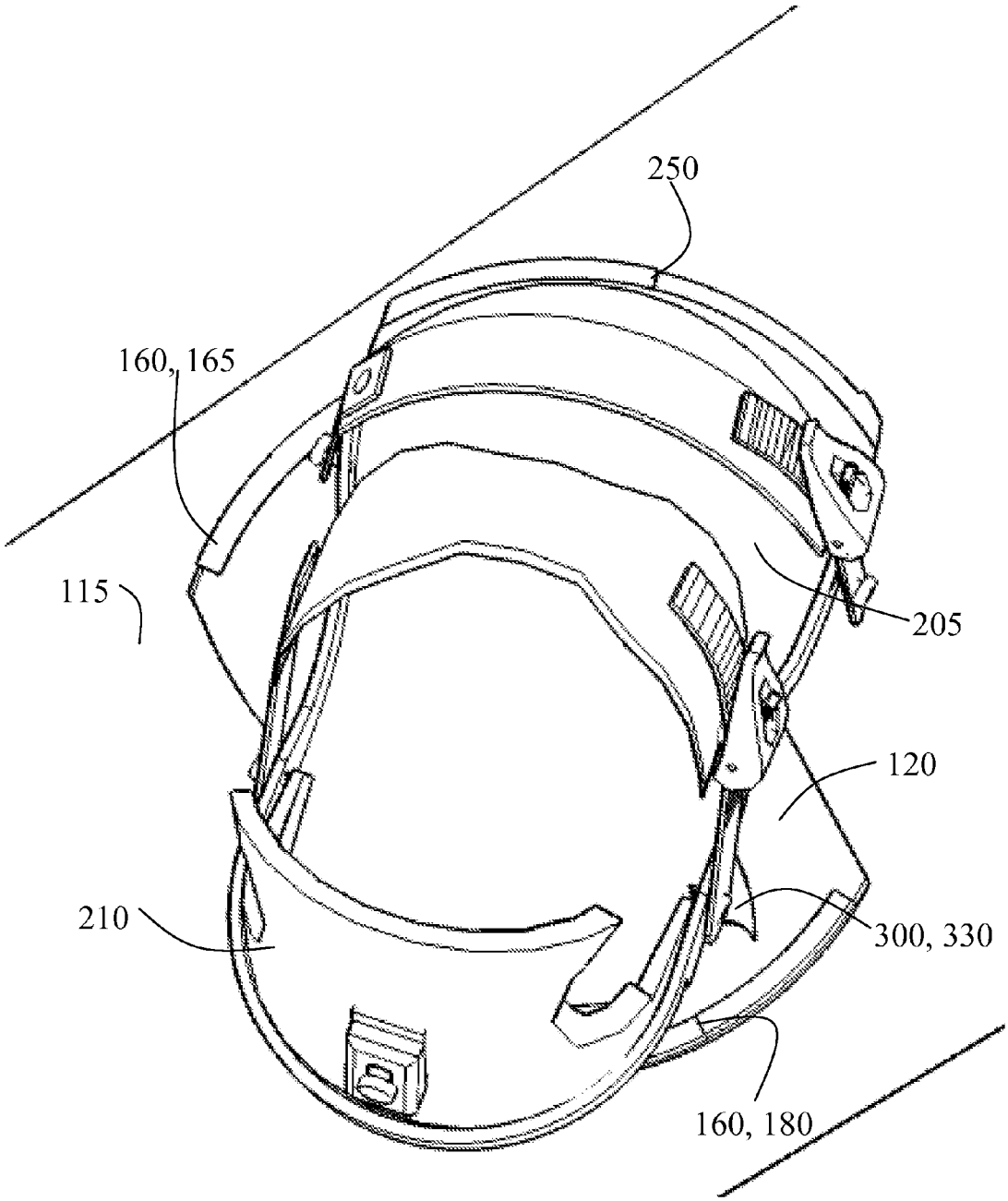
FIG. 7 is an overhead view of a binding base aligned with a board base for docking according to an embodiment of the disclosure.

In an embodiment of the disclosure such as FIGS. 5 and 6, the relative polarities of magnet 220 nearest to the toe end of binding base 125 and magnet 150 nearest to the toe end of board base/first layer 120, as installed, may be such that magnets 150, 220 attract one another, e.g., when the upright binding base 125 is placed vertically above the upper side of the board base/first layer 120, aligned, e.g., as FIG. 7 depicts. Similarly, in the depicted embodiment of the disclosure, magnets 150, 220 nearest to the heel ends of the respective bases may be installed so that those magnets are also mutually attracted, e.g., when the bases are aligned as FIG. 7 depicts. The respective polarities may also be chosen such that the respective pairs of magnets 150, 220 are mutually repelled, e.g., if binding base 125 is rotated 180 degrees relative to board base/first layer 120 from the alignment that FIG. 7 depicts.

In an embodiment of the disclosure, the corresponding magnets 150 in board base/first layer 120 and magnets 220 in binding base 125 may be substantially equal in size. In an embodiment of the disclosure, the corresponding magnets 150, 220 at each end of the respective bases 120, 125 may be vertically aligned relative to each other when binding base 125 and board base/first layer 120 are placed relative to one another, e.g., at an angle such as FIG. 7 depicts.

It will be appreciated that, in an embodiment of the disclosure such as FIGS. 1-7 depict, with magnets configured, e.g., as discussed above, magnetic attraction may hold board base/first layer 120 to binding base 125 in an alignment, e.g., as FIG. 7 depicts. Magnets 150, 220 may in an embodiment of the disclosure be chosen to be sufficiently strong such that the depicted alignment may be maintained, e.g., against gravity and/or incidental forces, until the user chooses to exert sufficient force to disturb that alignment. Suitable magnets are known in the art and may comprise, e.g., neodymium and/or other rare-earth magnets, but any sufficiently strong and compact magnets, and even electromagnets, may be used in an embodiment of the disclosure.

In an embodiment of the disclosure, one or more magnets may be replaced, e.g., with a piece of ferromagnetic material. In such an embodiment, each piece of ferromagnetic material in one base may correspond, e.g., to a magnet in the other base, e.g., such that magnetic attraction will pull the bases together into a docked configuration.

Binding base 125 in an embodiment of the disclosure may comprise lip features 250, e.g., corresponding to shelf features 160 of board base/first layer 120. In an embodiment of the disclosure, lip features 250 describe, e.g., portions of an imaginary circle in a manner similar to that in which shelves 160 of board base/first layer 120 describe portions of an imaginary circle. The imaginary circle that lip features 250 describe may in an embodiment of the disclosure have a slightly smaller diameter than that described by shelves 160, which may, e.g., be consistent with the functions of the lip and shelf features described below. As such, those skilled in the art will appreciate that any specifically described dimensions of lip features 250 (or any other components) should be taken as an example only and not to otherwise limit the scope of the disclosure.

In an embodiment of the disclosure, the placement and dimensions of lip features 250 may be such that, for some relative placements of board base/first layer 120 and binding base 125, lip features 250 and shelves 160 may be in an underlapping/overlapping configuration, e.g., such as FIGS. 8-14 illustrate. For example, in a configuration and/or alignment in which one or more of lip features 250 are located wholly or partially underneath one or more of shelves 160, e.g., as a result of rotation of binding base 125 relative to board base/first layer 120, shelf 160 may, e.g., prevent binding base 125 from being simply pulled apart (e.g., undocked) from board base/first layer 125. In an embodiment of the disclosure, the orientation of binding base 125 relative to board base/first layer 120 must be changed, e.g., by rotation of binding base 125 in the opposite direction, before the bases may be separated (e.g., undocked).

For example, in an embodiment of the disclosure such as the one in which shelves 160 on board base/first layer 120 have the dimensions described above, the lip features of binding base 125 may be approximately 1/16 of an inch thick and offset in height by 1/16 of an inch. The lower lips (e.g., 255, 260) may in such an embodiment of the disclosure be, e.g., flush with the bottom of binding base 125. The upper lips (e.g., 265, 270) may in such an embodiment be located, e.g., 1/8 of an inch from board base/first layer 125. The relative sizes and alignments of shelves 160 and lip features 250 may in an embodiment of the disclosure be such that lips 250 may slide relatively unimpeded below the respective corresponding shelves 160, e.g., as binding base 125 is rotated relative to board base/first layer 120, until a point of maximum rotation is achieved, e.g., as described below. Those skilled in the art will appreciate that the above described locations of the components (e.g., upper lips 265, 270, lower lips 255, 260, etc.) or any other components described herein are an example only and not intended to otherwise limit the scope of the disclosure.

Notwithstanding the foregoing, in an embodiment of the disclosure, as binding base 125 is rotated relative to board base/first layer 120 towards a configuration in which the bases are secured together for use, the relative tightness of the engagement of the bases may increase, e.g., to prevent or reduce any wobbling or other unsteadiness in the joint. One or more of shelves 160 and/or lips 250 may taper to increase this firmness, e.g., as the relative rotation increases. In such an embodiment, the required rotational force may increase as the degree of rotation increases, but the required force may not require, e.g., subjectively excessive exertion by the user.

Conversely, any such taper may, in an embodiment of the disclosure, be such that the relative tightness of the engagement of the bases is least at the point of initial engagement from, e.g., a docked configuration. Such a configuration may make it easier for a user to initially engage the bases by increasing the likelihood that the lips will engage properly with the shelves.

Figure 8:
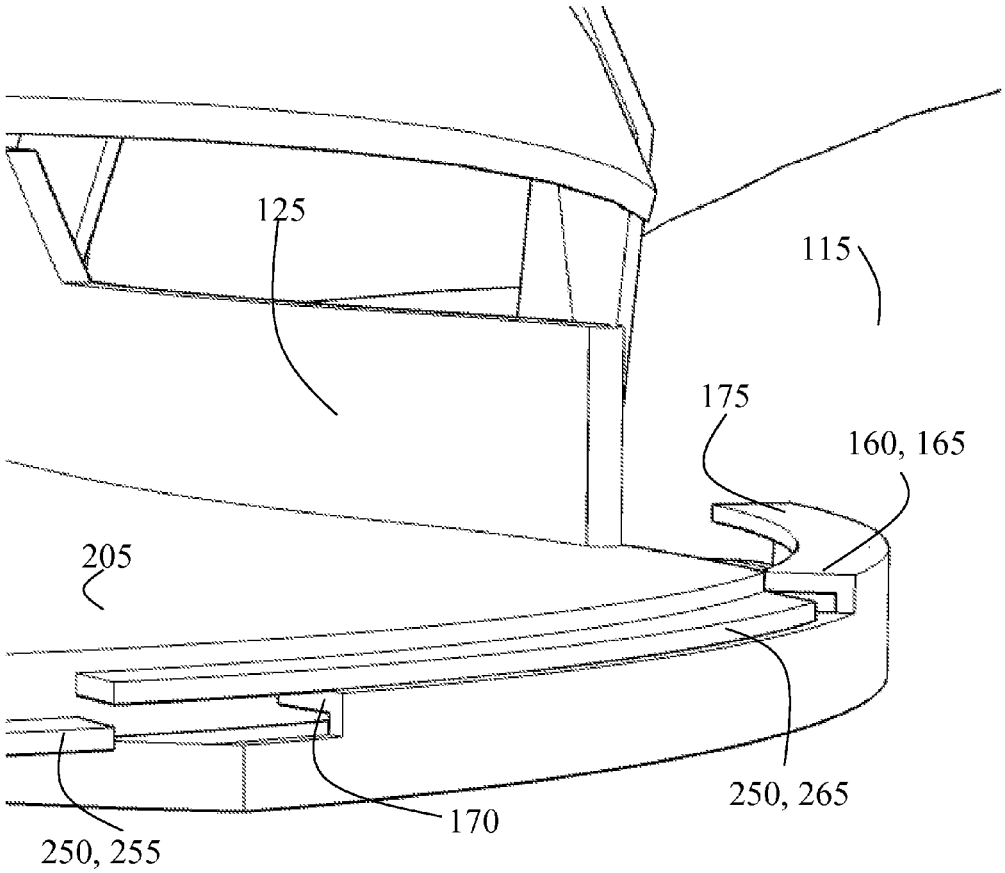
FIG. 8 is a view facing the toe end of a binding base docked with a board base according to an embodiment of the disclosure.
Figure 9:
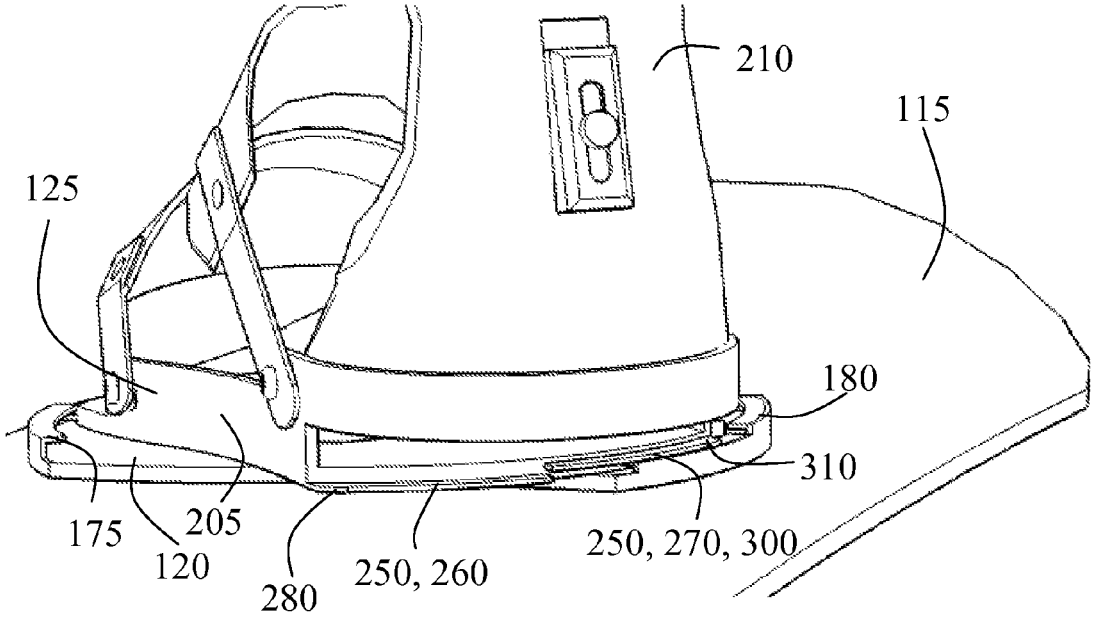
FIG. 9 is a view facing the heel end of a binding base docked with a board base according to an embodiment of the disclosure.
Figure 10:
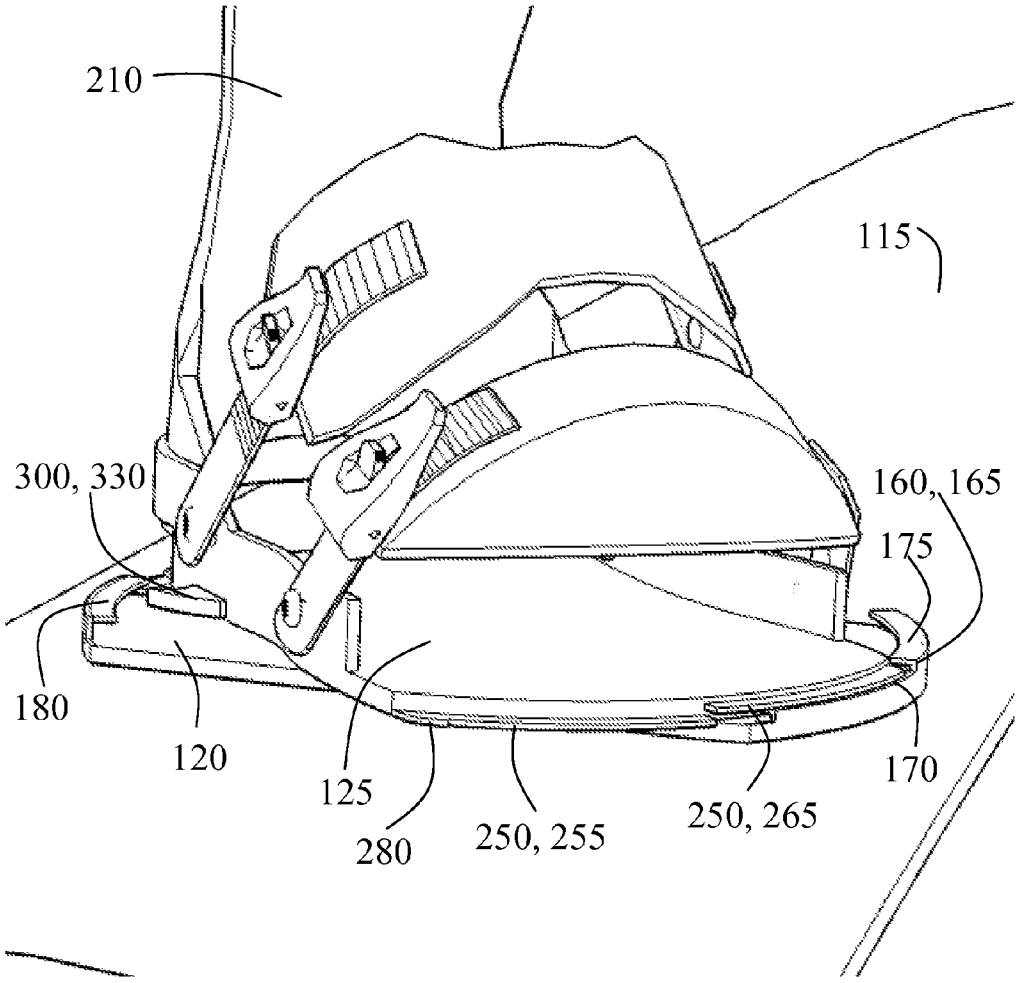
FIG. 10 is a view facing the toe end of a binding base docked with a board base according to an embodiment of the disclosure.
Figure 11:
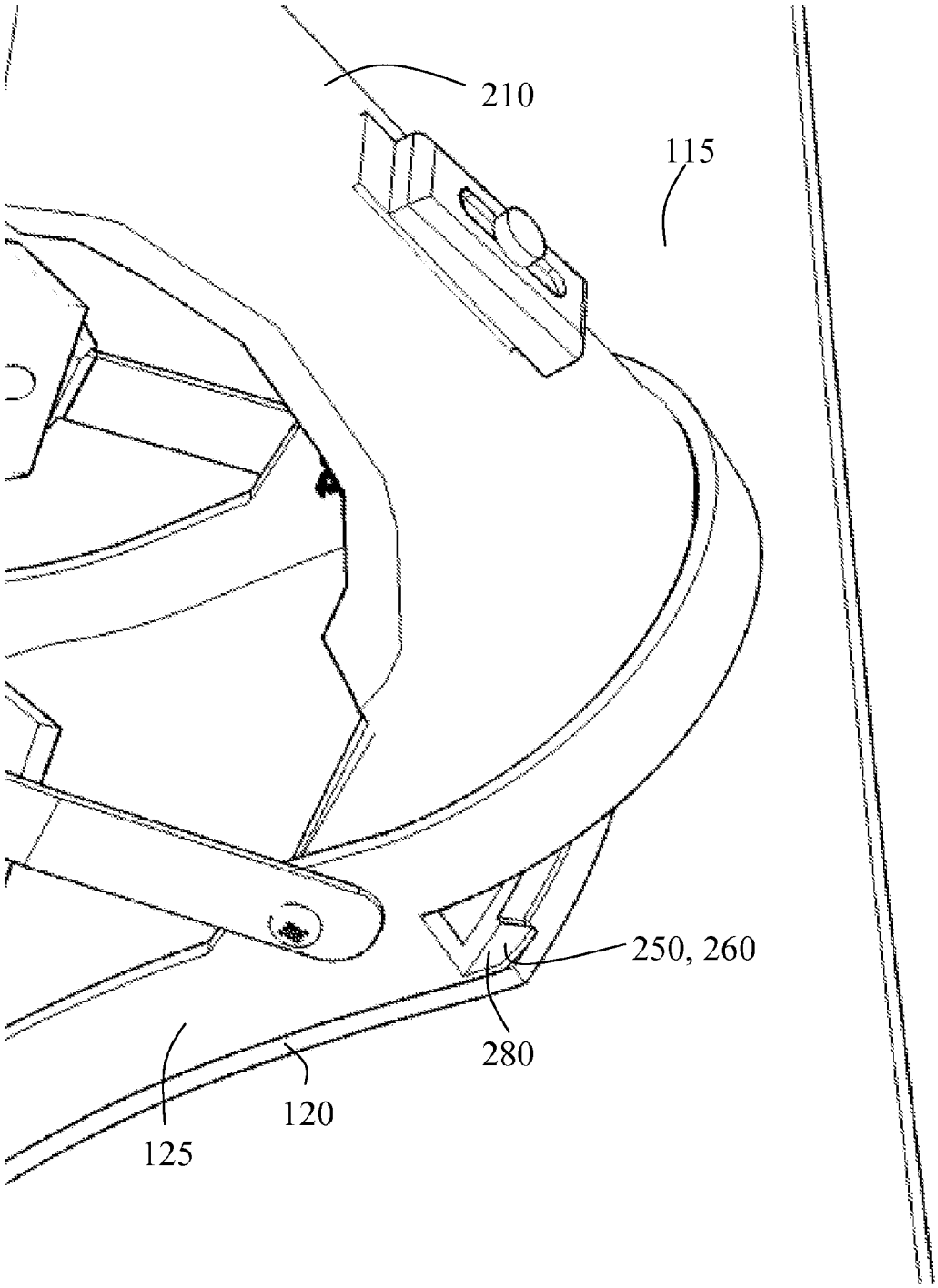
FIG. 11 depicts the heel ends of a binding base and a board base in a locked configuration according to an embodiment of the disclosure.
Figure 12:
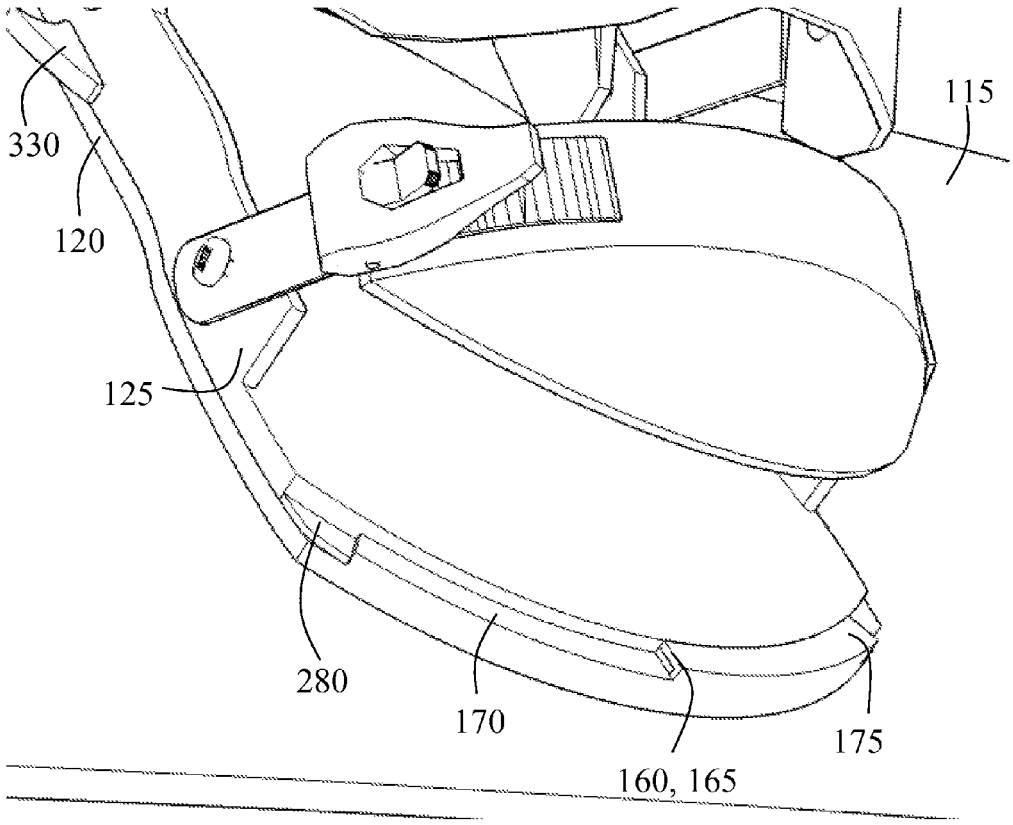
FIG. 12 depicts the toe ends of a binding base and a board base in a locked configuration according to an embodiment of the disclosure.
Figure 13:
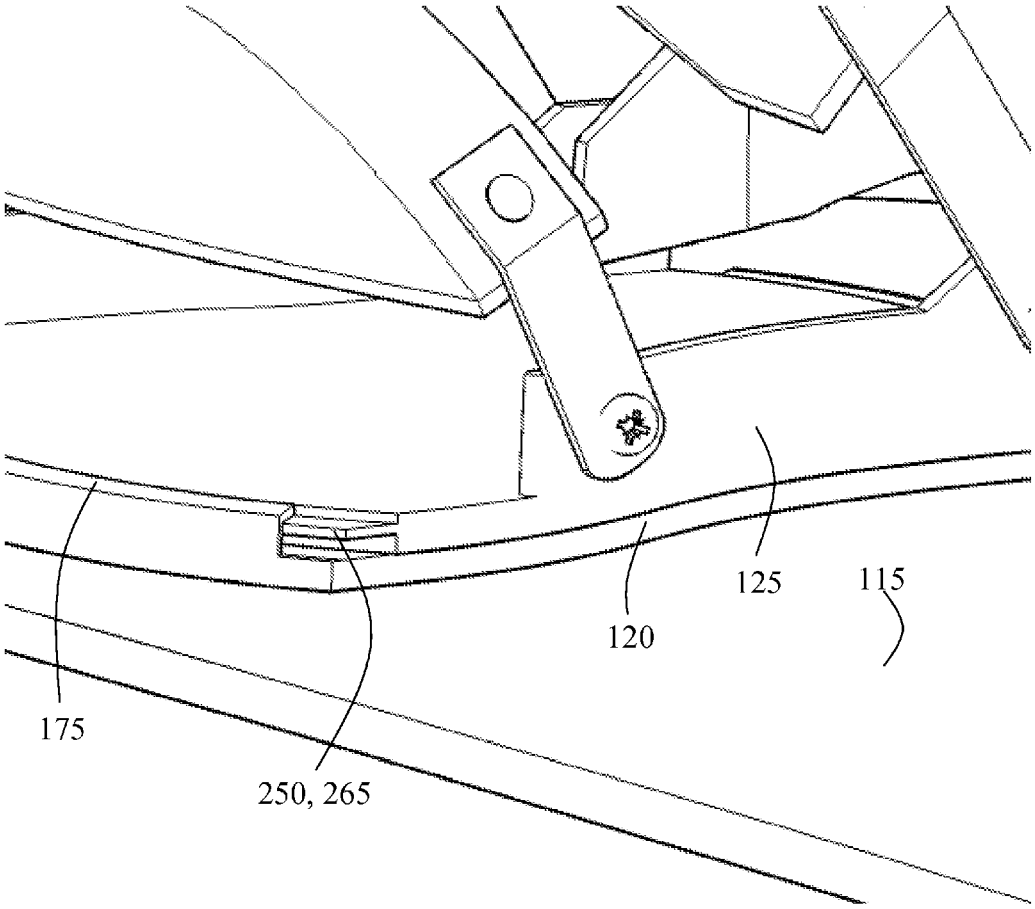
FIG. 13 depicts the toe ends of a binding base and a board base in a locked configuration according to an embodiment of the disclosure.

Returning to FIG. 7, as depicted, board base/first layer 120 and binding base 125 according to an embodiment of the disclosure are in what may be referred to as a docked configuration. Generally, in such a configuration, the corresponding meeting surfaces of the bases are sufficiently flush against one another to present no substantial impediments to rotating the bases relative to each other while maintaining substantial contact between the surfaces. As depicted in this example configuration, no overlap exists between any of lip features 250 and any of the shelf features such as might interfere with the contact between the meeting surfaces of the bases. FIGS. 8-10 depict the relative positions of lip features 250 and shelves 160 when the bases are in a docked configuration according to an embodiment of the disclosure.

It will be appreciated that in an embodiment of the disclosure such as depicted in one or more of the figures, the magnets may tend to hold the bases in a docked alignment such as is shown by FIG. 7. In an embodiment of the disclosure, geometry and/or one or more corresponding structures on one or both bases may serve to guide the bases into a docked configuration and/or to retain them in such a configuration, in addition to or instead of magnets as described above. It will be appreciated that in an embodiment of the disclosure in which rotation is used to engage structures that retain the bases in a joined configuration, any such structures may be designed not to interfere with such rotation: for example, a circular indentation in the underside of binding base 125 may correspond to a circular raised portion on the upper side of board base/first layer 120.

In the example embodiment of the disclosure, the corresponding lip structures 250 and shelves 160 engage to retain the binding after minimal counterclockwise rotation of binding base 125 relative to board base/first layer 120. In an embodiment of the disclosure, maximal counterclockwise rotation may be achieved when the lateral edges of the bases are evenly aligned with one another. For example, in the example embodiment of the disclosure, beginning from the docked configuration, binding base 125 may rotate counterclockwise through an angle of, e.g., 45 degrees, at which point a locking mechanism engages. FIGS. 11-14 depict the bases in such a configuration according to an embodiment of the disclosure. In the depicted embodiment, one or more of lips 250 may incorporate projection 280 that may be placed to encounter the edge of one or more of the corresponding shelves 160, e.g., to impede rotation beyond the point of maximum relative rotation.

It will be appreciated that the depiction in FIGS. 11-14 is an example and not limiting. For example, in an embodiment of the disclosure, the direction of rotation may be clockwise instead of counterclockwise. As another example, in an embodiment of the disclosure, the angle of relative rotation traversed from the docked configuration to the locked configuration may be greater or lesser than 45 degrees.

At this point of relative rotation after being docked, in an embodiment of the disclosure, a locking mechanism may secure the bases in their relative positions, e.g., making the board (e.g., snowboard) and binding (e.g., snowboard binding) ready for riding. In an embodiment of the disclosure, a locking mechanism comprises a sliding, spring-loaded latch. The latch may engage, e.g., when the binding base has engaged with the board base/first layer and been rotated counterclockwise until the edges of the bases are flush with one another, and the latch may thereby maintain the relative positions of the bases, e.g., while the user is riding the snowboard. In an embodiment of the disclosure, the user may manually disengage the latch, e.g., by sliding or otherwise moving one or more components, thereby allowing, e.g., clockwise rotation of the binding base relative to the board base/first layer, returning the bases to a docked configuration, in which the bases may be disengaged (e.g., undocked).

Figure 14:
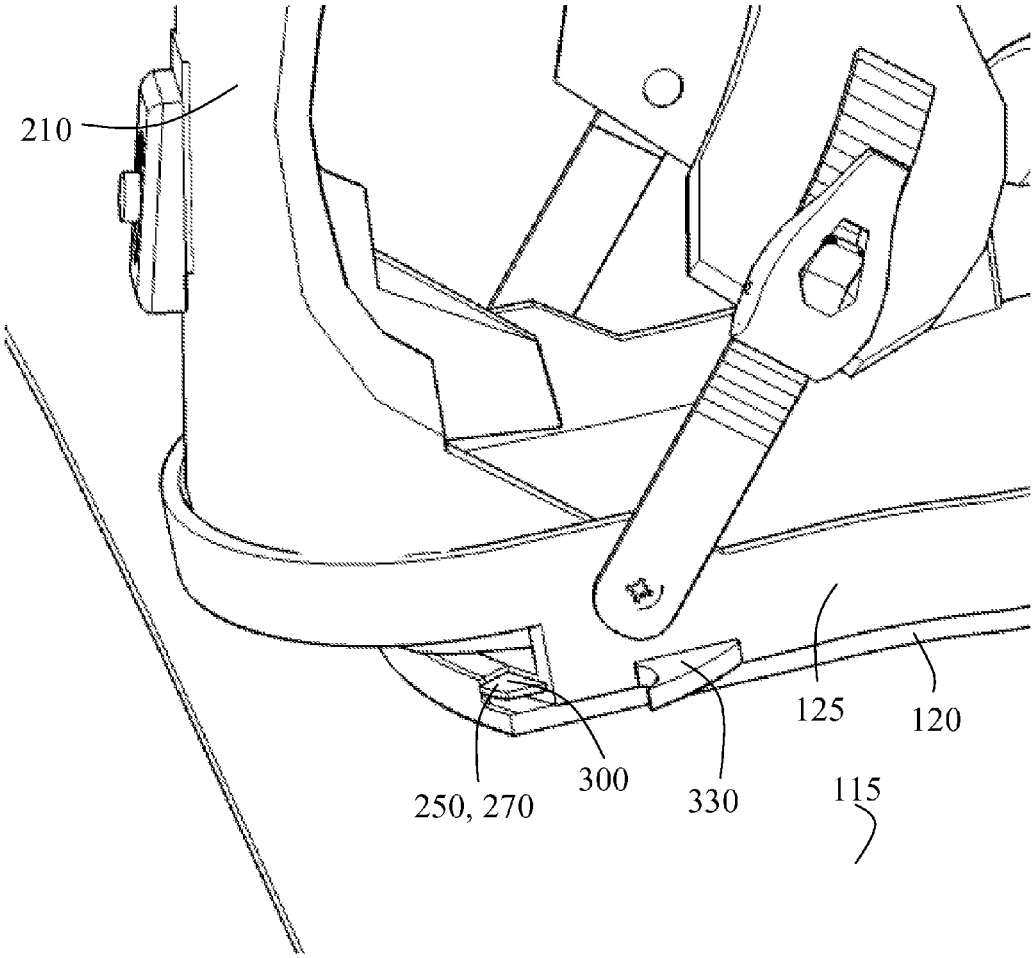
FIG. 14 depicts the heel ends of a binding base and a board base in a locked configuration according to an embodiment of the disclosure.
Figure 15:
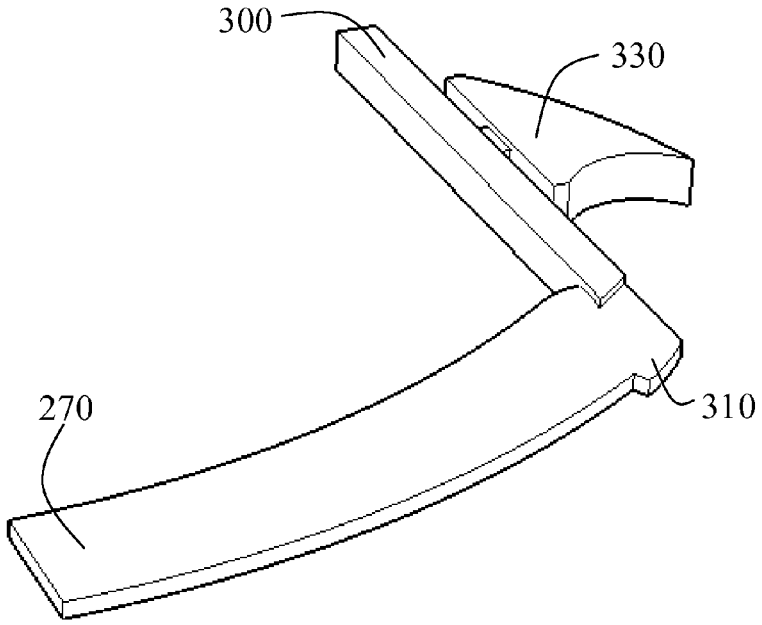
FIG. 15 depicts a latch according to an embodiment of the disclosure.
Figure 16:
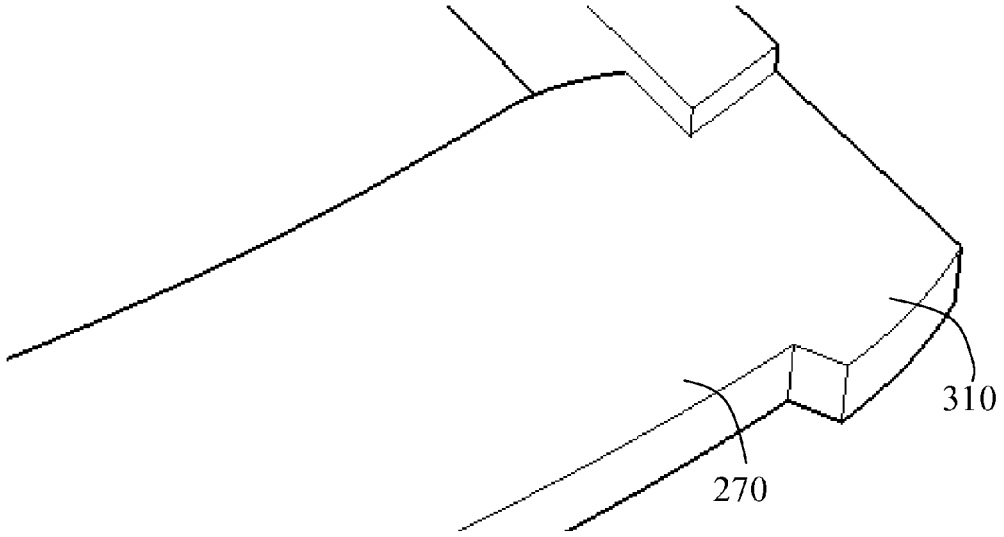
FIG. 16 depicts a projection from a lip feature that may be incorporated into a latch according to an embodiment of the disclosure.

FIGS. 15-22 depict an example locking mechanism, including a latch as described above, according to an embodiment of the disclosure. FIG. 15 depicts sliding latch 300, according to an embodiment of the disclosure, which incorporates heel-side lip 270. In the depicted embodiment of the disclosure, lip 270 incorporates projection 310 shaped to push latch 300 into binding base 125 while the bases are engaged. As depicted, the shape of projection 310, combined with the corresponding shape of shelf 180 (FIG. 2) of board base/first layer 120 (FIG. 2) may also allow latch 300 to extend from binding base 125 when the bases are rotated to the locking position. By extending when the bases are in, e.g., a relative alignment such as FIG. 14 depicts, in an embodiment of the disclosure, the projection may hold the bases in this relative position.

Figure 17:
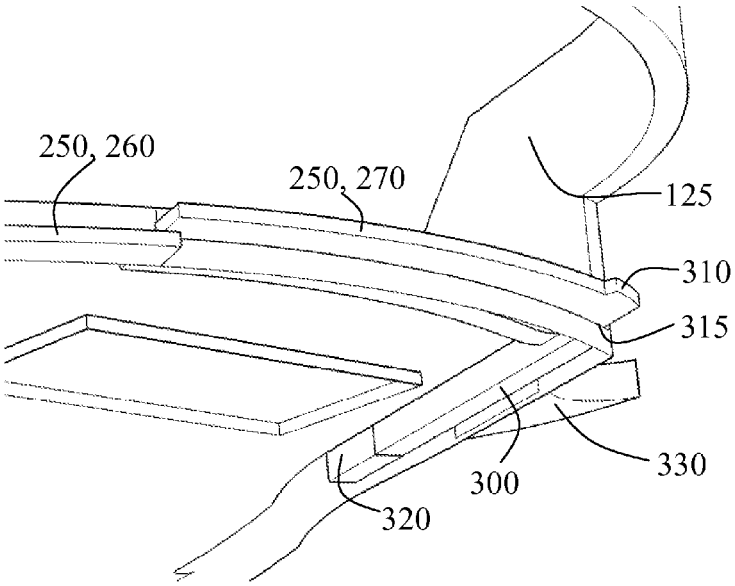
FIG. 17 depicts a latch assembled into a binding base according to an embodiment of the disclosure.

FIG. 17 depicts latch 300 assembled into binding base 125 according to an embodiment of the disclosure. (In FIGS. 17 and 18, the bottom of binding base 125 has been cut away to reveal one or more features of binding base 125.) In such an embodiment, heel-side lip 270 incorporated into latch 300 may extend outwards from the heel side of binding base 125 through slot 315 in binding base 125. In an example embodiment of the disclosure, the dimensions of slot 315 may be, e.g., slightly larger than those of lip 270, chosen to allow latch 300 to slide freely in slot 315 yet minimize vertical and horizontal play of latch 300 in slot 315 while in use. As noted above, all dimensions, including those described with regard to slot 315 and lip 270, are examples only and not to otherwise limit the scope of the disclosure.

The position of slot 315 in binding base 125 may be chosen, e.g., so that lip 270 engages with the corresponding shelf 180 (FIG. 2) on board base/first layer 120 when the bases are docked and then rotated.

Figure 18:
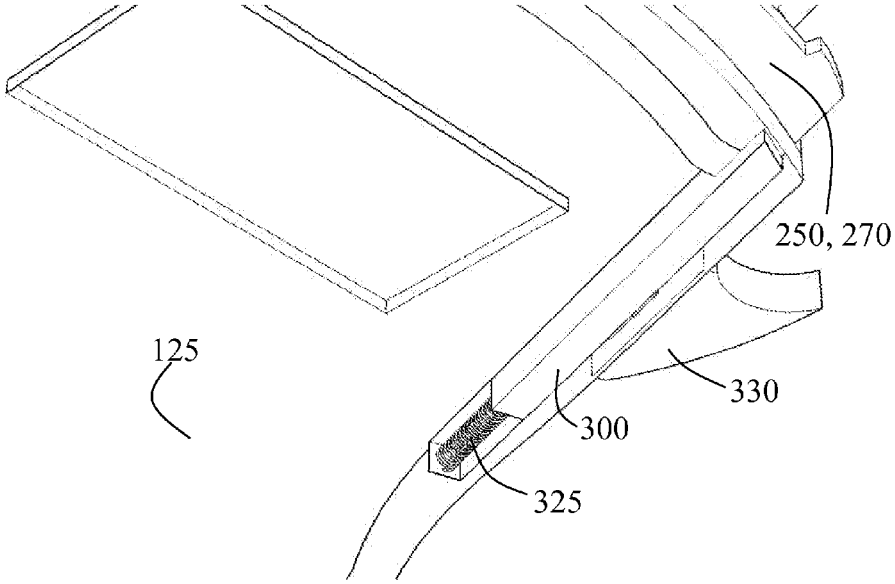
FIG. 18 is a cutaway view of binding base including a spring-loaded latch according to an embodiment of the disclosure.

As FIG. 17 depicts, binding base 125 in an example embodiment of the disclosure includes receptacle 320 or guide configured to receive the end of latch 300 opposite to lip 270. In an example embodiment of the disclosure, spring 325 may be held in receptacle 320 such that, when latch 300 is pushed into binding base 125, spring 325 exerts a force tending to push the latch back out. FIG. 18 depicts binding base 125 with receptacle 320 cut away to illustrate the relative placement of latch 300, spring 325, and binding base 125 according to an embodiment of the disclosure. However, those skilled in the art will recognize that differing relative placements of latch 300, spring 325, and binding base 125 may be used to accomplish the same or similar results without departing from the scope of the disclosure.

In an embodiment of the disclosure, the configuration of latch 300, receptacle 320, and binding base 125 may be such that at least a portion of latch 300 remains within receptacle 320 regardless of the degree to which latch 300 has been pushed into binding base 125 or extends outward from it, e.g., to help maintain the relative alignment of latch 300 and binding base 125.

Figure 19:
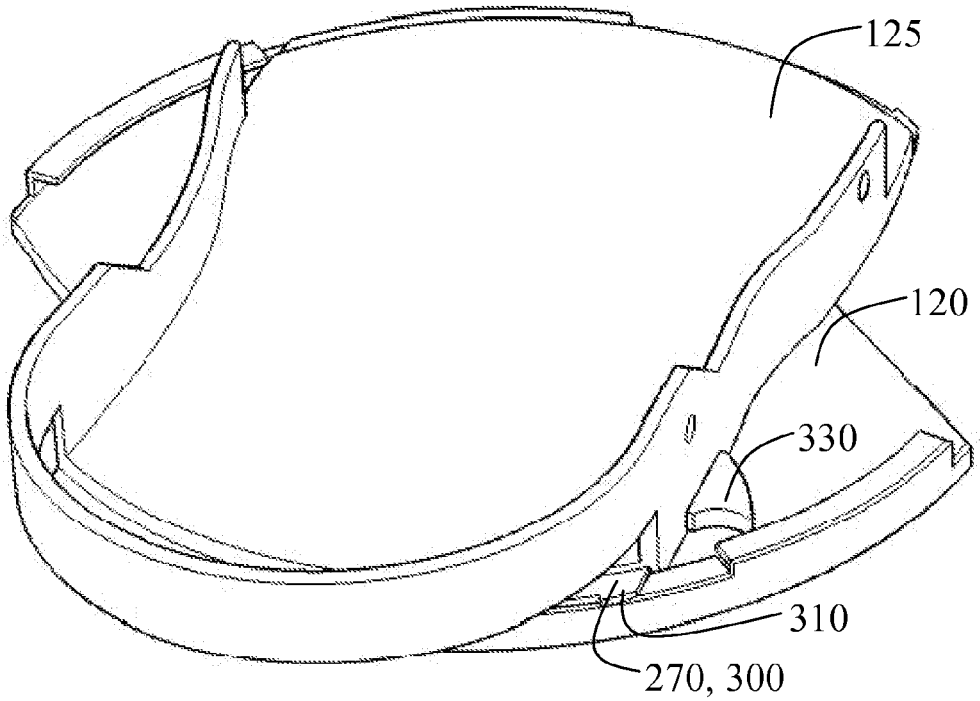
FIGS. 19-22 depict a latch through relative rotation of a board base that is engaged with a binding base according to an embodiment of the disclosure.

FIGS. 19-22 illustrate an example relative position and interaction of latch 300, binding base 125, and board base/first layer 120 as the bases are docked, engaged, and locked according to an example embodiment of the disclosure. In FIG. 19, the bases have been docked, e.g., as described above, but have not been engaged, e.g., by rotation of the binding base 125 relative to the board base/first layer 120.

Figure 20:
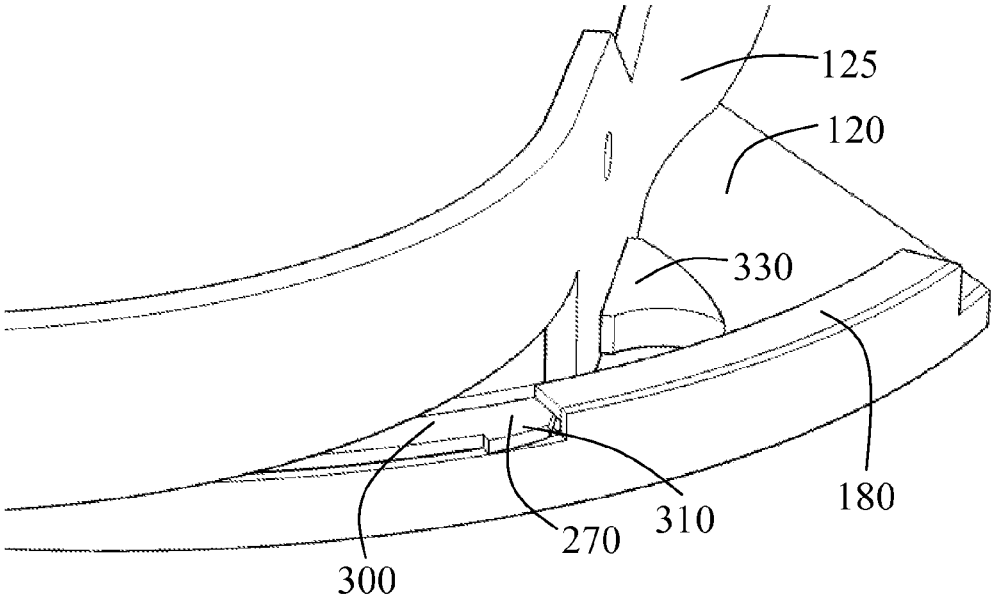

As depicted in FIG. 20, the bases have been rotated from the docked position so that lip 270 has begun to engage shelf 180. According to an example embodiment of the disclosure, one or more other lips may engage the respective corresponding shelves at a greater or smaller angle of relative rotation than that at which lip 270 incorporated into latch 300 begins to engage. As depicted in FIG. 20, the shape of projection 310 from lip 270 is such as to exert a force, e.g., radially inward on lip 270 as the degree of relative rotation increases, pushing latch 300 into binding base 125.

Figure 21:
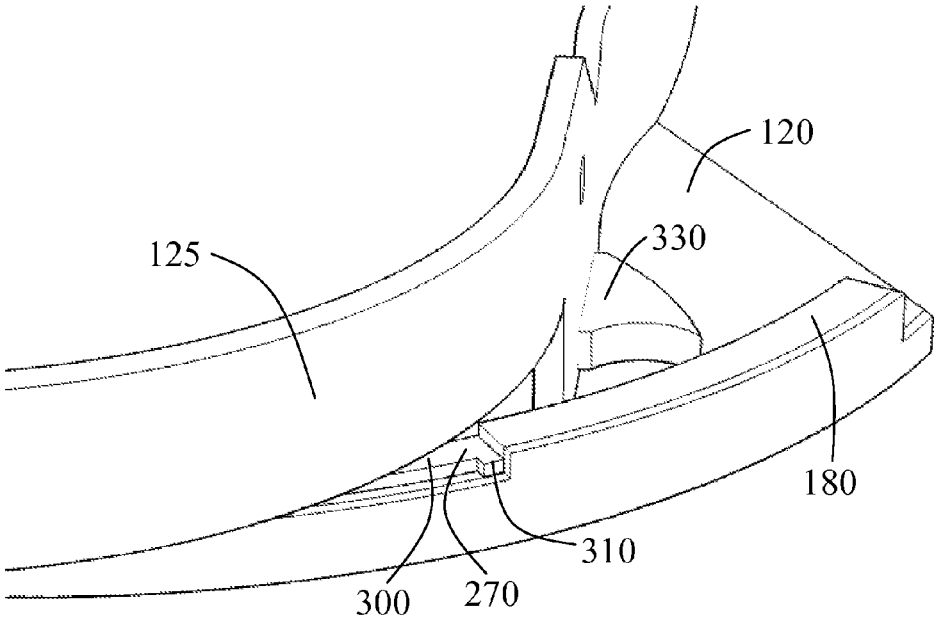

FIG. 21 depicts binding base 125 and board base/first layer 120 at a slightly greater angle of rotation than that depicted in FIG. 20, according to an example embodiment of the disclosure. In an embodiment such as is depicted, the shape of projection 310 may be such that further rotation of binding base 125 relative to board base/first layer 120 will not push latch 300 substantially further into the binding base.

Figure 22:
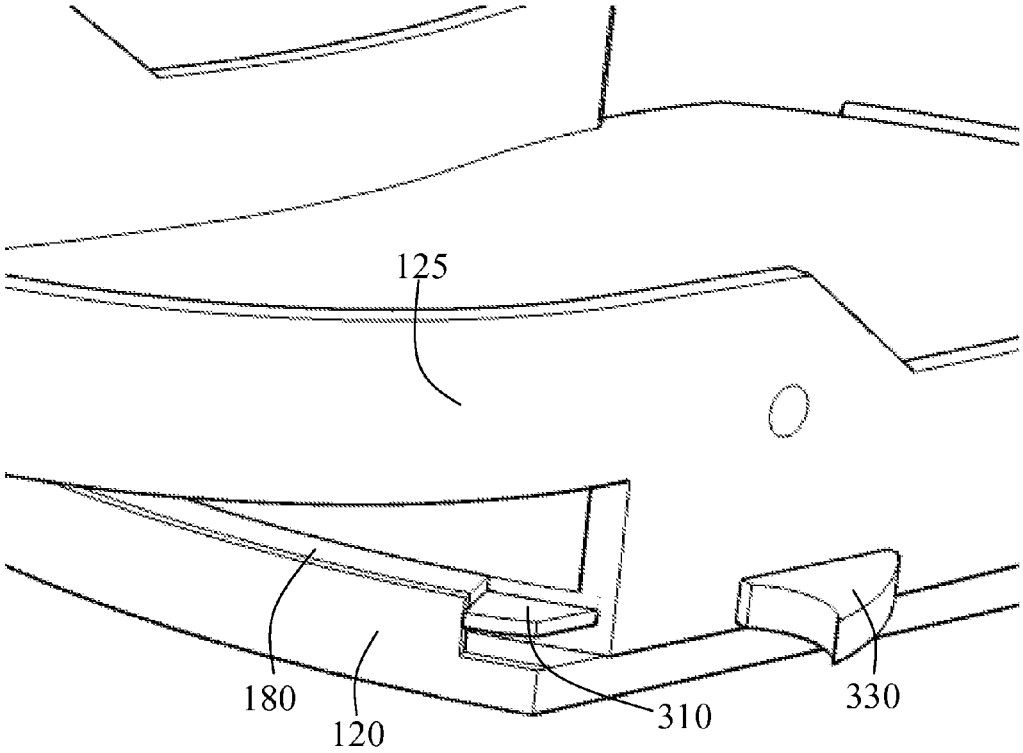

FIG. 22 depicts an example embodiment with binding base 125 and board base/first layer 120 at maximal relative rotation, in a locked configuration, e.g., suitable for use according to an embodiment of the disclosure. In the example embodiment of the disclosure such as FIG. 22 depicts, shelf 180 may not extend to the outward lateral edge of binding base 125. So configured, when maximal relative rotation is achieved, projection 310 may be freed from the inward radial force and may consequently be pushed outward by spring 325 (not pictured). In the example embodiment of the disclosure, the inner edge of projection 310 may rest against the outer edge, e.g., of shelf 180 or its vertical support, thereby impeding clockwise rotation of binding base 125 relative to board base/first layer 120.

In an example embodiment of the disclosure such as FIG. 22 depicts, latch 300 may comprise, e.g., slider 330, which may be used to push latch 300 back into binding base 125, disengaging the locking mechanism and allowing the clockwise rotation of binding base 125 relative to board base/first layer 120. Such rotation may, in an embodiment of the disclosure, return the bases, e.g., to a docked position, allowing the user to separate (e.g., undock) them.

Figure 23:
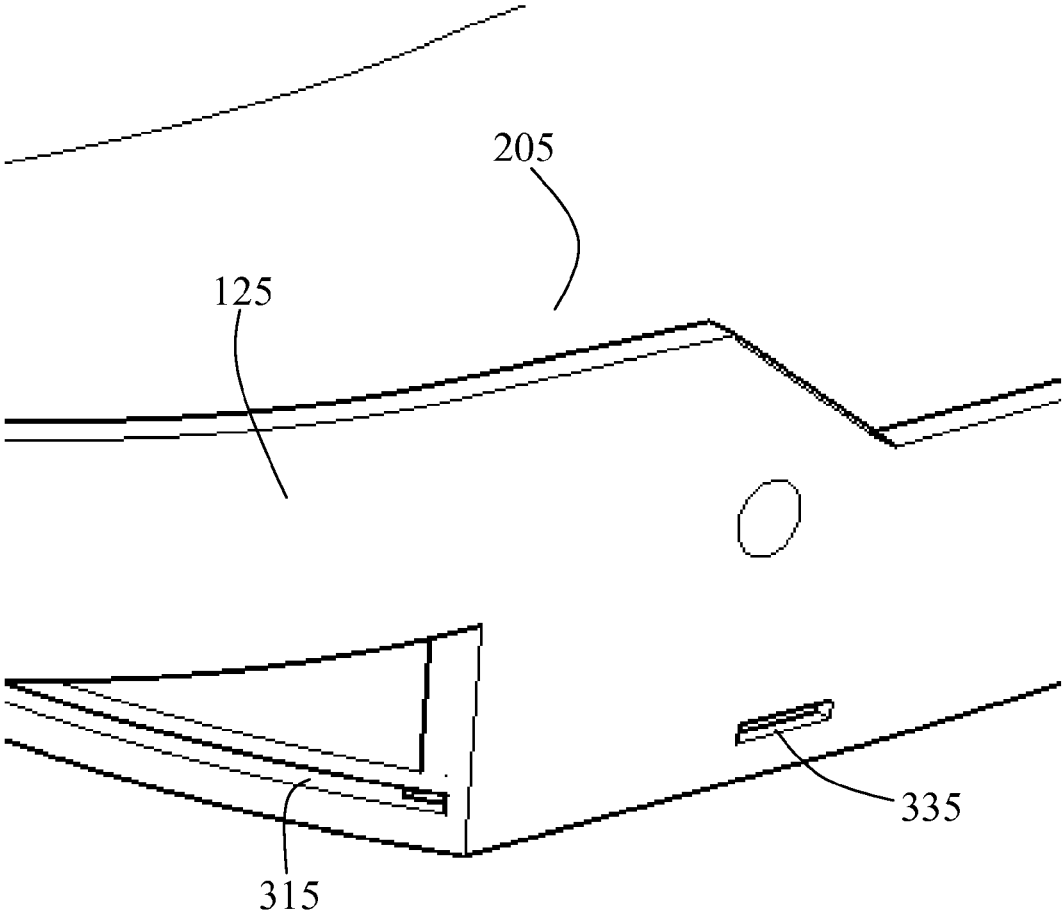
FIG. 23 depicts a base of a binding base according to an embodiment of the disclosure.

In an embodiment of the disclosure, a portion of latch 300 may extend, e.g., through slot 335 (FIG. 22) in the outer side of binding base 125, and slider 330 may be attached to latch 300, e.g., during assembly. Such a configuration, according to an embodiment of the disclosure, may also, e.g., further stabilize the relative alignment of latch 300 relative to binding base 125. FIG. 23 depicts an example base 205 of binding base 125 that incorporates slot 315 for lip 270 of a shelf and slot 335 for passing part of latch 300 through, to slider 335, according to an embodiment of the disclosure.

It will be appreciated that an embodiment of the disclosure and/or any one or more components thereof may be made of any one or more suitable materials separately or in combination. For example, suitable materials for board base/first layer 120, binding base 125, and/or latch 300 in an example embodiment of the disclosure may include, e.g., plastic (including but not limited to polycarbonate and/or other thermoplastics), nylon, glass injected plastic, carbon fiber, and aluminum and other lightweight, durable metals, among many other possibilities.

The example dimensions of the components of an embodiment of the disclosure may reflect the intended use of the embodiment, including, for example, considerations such as the expected sizes of board deck (e.g., snowboard deck 115) to which board base/first layer 120 may be secured and the boot (and, by extension, the user's foot) that may be secured within binding base 125. In one example embodiment of the disclosure, board base/first layer 120 may be roughly 6 inches wide (meaning left to right in relation to the user's foot and boot), approximately 9 inches long (meaning toes to heel in relation to the user's foot and boot), and approximately 3/16 inch thick. In an embodiment of the disclosure, board base/first layer 120 will match the outline dimensions of binding base 125 to create a flush fit when the entire system is locked and operable. It will be appreciated that these dimensions may be departed from significantly or slightly, with or without maintaining any or all proportions, without affecting the operating principle of embodiments of the disclosure.

It will be appreciated that an example embodiment of the disclosure may be configured such that a user may dock, engage, and lock the bases as described herein in connection with embodiments of the disclosure and may permit a user to easily secure the user's foot to a snowboard for use without use of the hands. For example, a user may be seated, e.g., on a ski lift, with one foot secured to a snowboard, e.g., by a conventional binding or by a binding according to an embodiment of the disclosure. The user's other foot may be wearing a boot that is secured within binding base 125 according to an embodiment of the disclosure, and binding base 125 may correspond to board base/first layer 120 that may be permanently secured to snowboard deck 115.

In such circumstances, according to an embodiment of the disclosure, the user may dock board base/first layer 120 with binding base 125, e.g., by moving a foot so that the bottom of the foot (and thus the bottom of binding base 125) is within a few inches of the top of board base/first layer 120, canted approximately, e.g., 45 degrees counterclockwise to the board base/first layer. So aligned, in accordance with an example embodiment of the disclosure when magnets are used, magnetic attraction may, e.g., draw board base/first layer 120 and binding base 125 into a docked configuration.

Having docked board base/first layer 120 and binding base 125, the user may then rotate the boot and the enclosing binding base 125, e.g., 45 degrees counterclockwise to a point of, e.g., maximum relative rotation, e.g., as described above, at which the edges of the bases are flush with one another. Latch 300 may then engage/lock, holding the bases in such a relative alignment until released by the user.

The relative placement and sizes of the lips and shelves may in an example embodiment of the disclosure hold the bases firmly together. While locked in such a position, the effect of the joined bases may, in an embodiment of the disclosure, be considered equivalent to creating a solid, e.g., 7/16 inch base.

Figure 24:
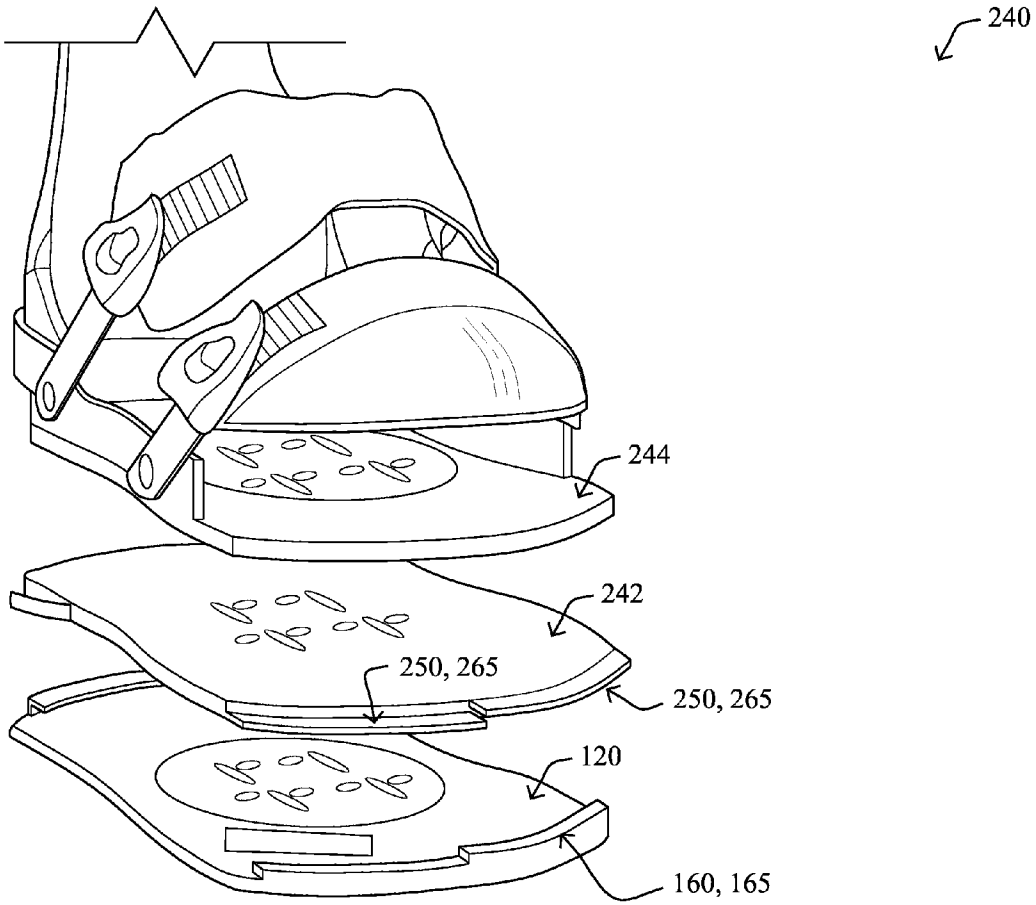
FIG. 24 is an exploded perspective showing an embodiment of the disclosure.

FIG. 24 illustrates an example embodiment of the disclosure where one or more embodiments or portions of embodiments described above may be retrofit to a conventional binding to achieve some or all of the benefits of the present disclosure. For example, binding 240 may be a standard binding as is conventionally found in the snowboard industry, however, intermediate adapter plate 242 may be secured, e.g., to bottom plate 244 of binding 240. The board base/first layer may be as described above with regard to the example embodiments illustrated in FIGS. 1-23. Intermediate plate 242 may (but need not) include the magnets on the underside as they are found and shown, e.g., in FIG. 5, at 220 as well as front lips 250 and 265, as illustratively depicted in FIG. 8. Intermediate plate 242 may be secured to bottom plate 242 of binding 240, and in all respects the three piece assembly shown in FIG. 24 may operate substantially identical as the two piece assembly shown in FIGS. 1-23, except that when plate 242 is joined or connected to plate 244 of binding 242, there again is a two piece assembly. Additionally/alternatively, the binding base/second layer may be considered to be the intermediate adapter plate (either whole or in part) for purposes of retrofitting a conventional binding to achieve one or more benefits of the present disclosure. Those skilled in the art will appreciate that any other techniques for retrofitting a conventional binding to achieve some or all of the benefits of the present disclosure may also be used without departing from the scope of the disclosure. As such, any particular description of retrofitting a conventional binding (or board, boot, etc.) to achieve some or all of the benefits of the present disclosure should be taken as an example only and not to otherwise limit the scope of the disclosure.

Suitable bolts, screw or the like may be provided to firmly connect intermediate adapter plate 242 to 244.

As will be appreciated by those skilled in the art, while the above description generally applies to snowboarding activities, the example binding design embodiments of the disclosure may be utilized with any and all boards, such as those that may use one or more bindings, for example, wave boarding, kite boarding/kite surfing, wake boarding, etc. It is also contemplated that other boards that may not generally use bindings, such as skateboards, may also benefit from the disclosure. As such, any description of a snowboard should be taken as example only and not to otherwise limit the scope of the disclosure.

Figure 25:
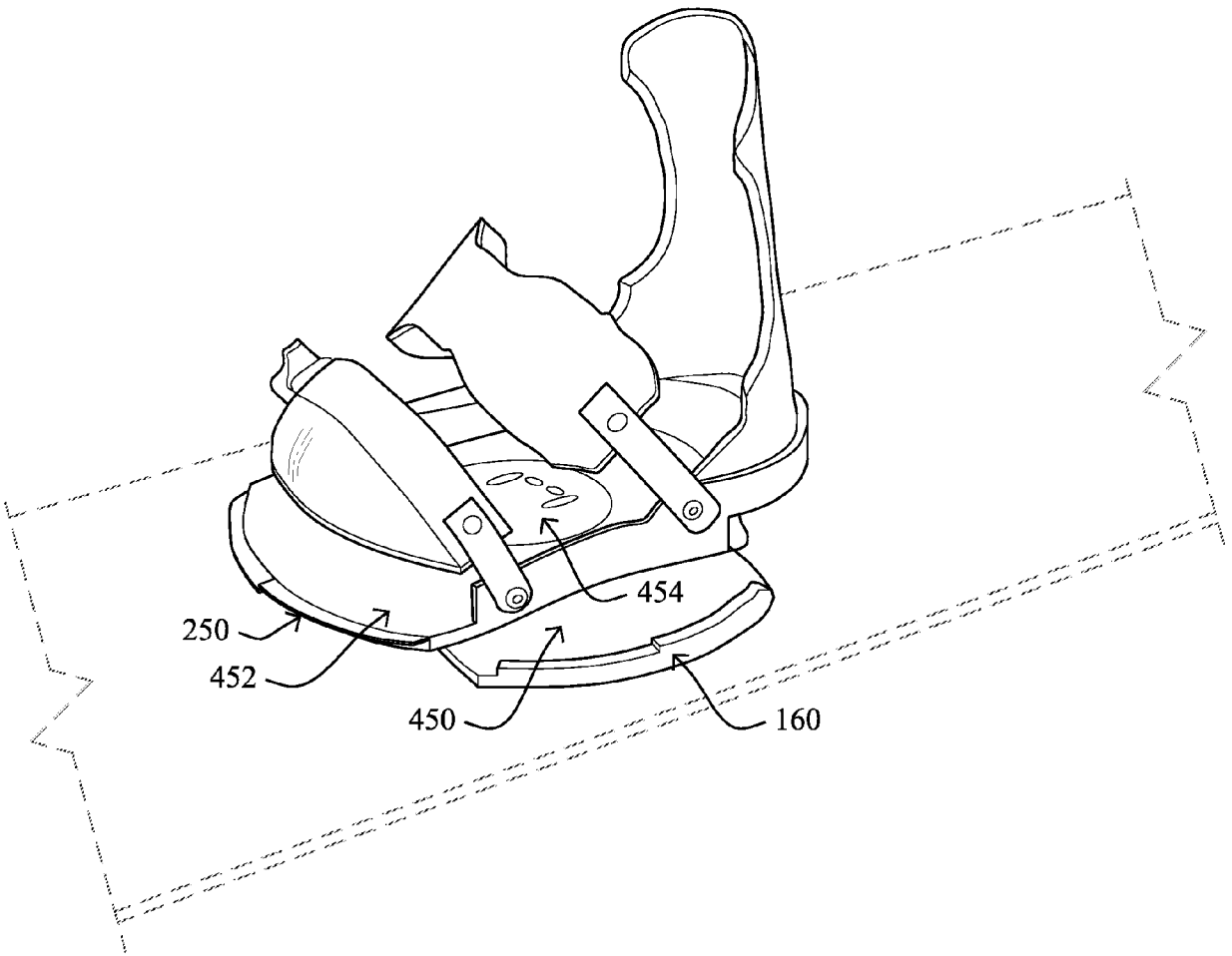
FIG. 25 is a perspective view of an embodiment of the disclosure in which the front binding is capable of being rotated with respect to the board so that the front binding is parallel to the rear foot which has been released from the board.

FIG. 25 is a perspective view of another embodiment of this disclosure in which the front binding is capable of being rotated with respect to the board so that the front binding is parallel to the rear foot which has been released from the board so that the front and rear feet face forward, facilitating movement of the snowboarder when the rear foot is disconnected from the board. The binding comprises lower plate 450 attached to the board with rotatable binding 452 rotatable about turret 454 centrally located between plate 450 and 452. The concept of using lips and flanges similar to 250 and 160 as in FIG. 8 to maintain the front binding locked in place when snowboarding may be seen in FIG. 25.

Figure 26:
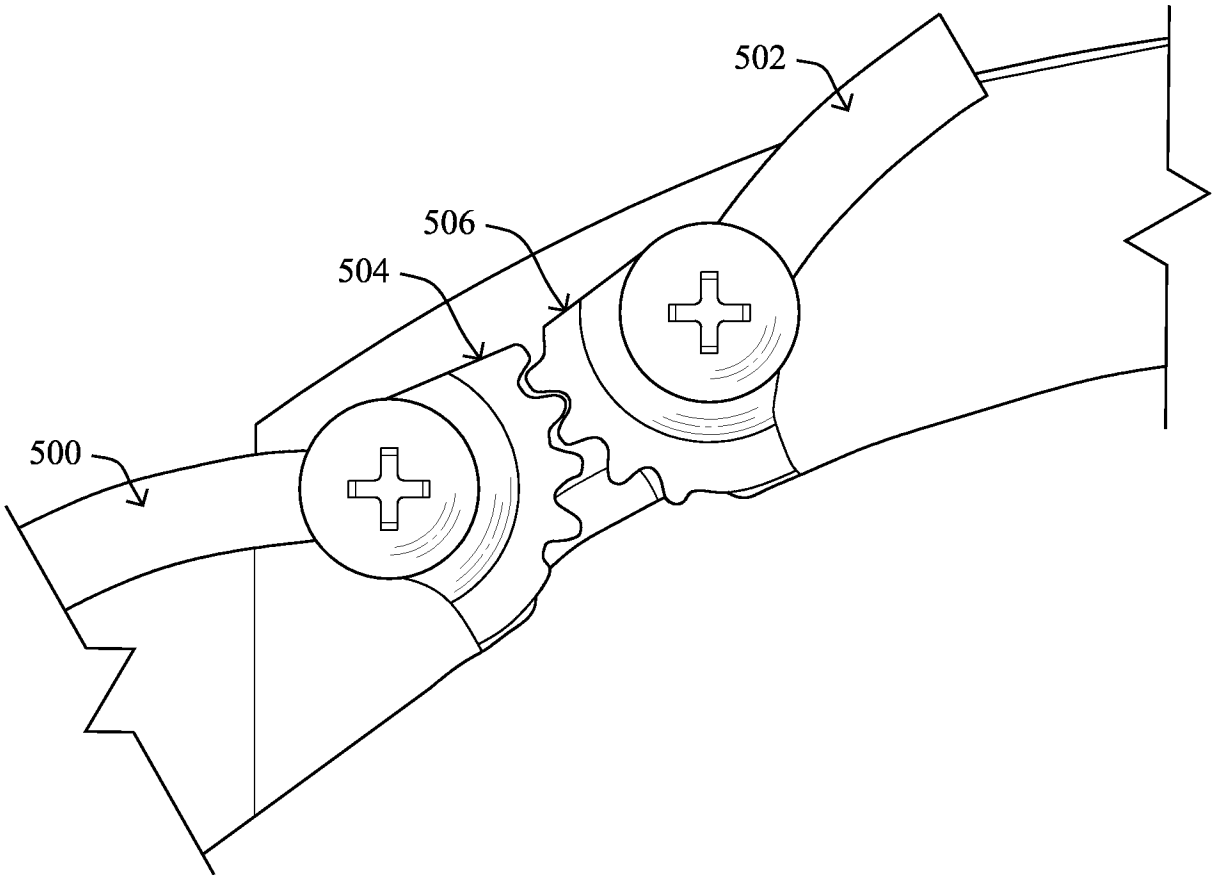
FIG. 26 is an embodiment of the locking system according to an embodiment of the disclosure.

Additionally/alternatively, cams (e.g., cams 500 and/or 502) may replace or supplement one or more shelves (e.g., shelve 160). For example, FIG. 26 is a top view of an example embodiment for a rear (and/or front) locking portion of the locking system of the disclosure. Cams 500 and 502 may be rotatable and interconnected through matching nubs (e.g., 504 and 506) respectively of the cams. When the cams are rotated out of the locking position, members 500 and 502 are pushed downwardly, or either one could be pushed downwardly, freeing up the locking mechanism. The interconnected camming mechanism may more easily facilitate release of the locking mechanism. Moreover, the locking mechanism may enable a progressive (e.g., analog) locking system, as opposed to a spring-loaded locking mechanism described with regard to one or more of the above embodiments. However, those skilled in the art will appreciate that any mechanism/technique may be used that prevents a docked and locked first and second layer from becoming unlocked and undocked. As such, any described docking and locking technique should be taken as an example only and not to otherwise limit the scope of the disclosure. Moreover, while a specific cam and nub system is described above, those skilled in the art will recognize that any cam system that engages surfaces to increase tension, e.g., of a locking mechanism, via frictional forces may be used without departing from the scope of the disclosure. Thus, any description of a particular cam system should be taken as an example only and not to otherwise limit the scope of the disclosure.

As discussed above, each locking mechanism is configured to prevent binding base/second layer 125 from undocking with board base/first layer 120 in response to the second layer moving in a first direction when binding base/second layer 125 is docked with board base/first layer 120. At least some of the embodiments described herein refer to the first direction being a rotation of board base/first layer 120 with regard to binding base/second layer 125 to engage the locking mechanism, again, while in a docked position. However, those skilled in the art will recognize that any particular direction(s) may also be utilized in place of or in addition to those described between the bases to engage the locking mechanism, such as a forward direction, a backward direction, a left direction, a right direction, a diagonal direction, the rotating direction around an axis perpendicular to board base/first layer 120, or combination(s) thereof. As such, any description of a particular direction used to engage the locking mechanism while in a docked position should be taken as an example only and not to otherwise limit the scope of the disclosure.

Another example embodiment of the disclosure is to extend the concept of the rotation elements to both lock and release the boot from the board to other boards, e.g., wave boarding, kite-boarding, etc. In these example situations, the boarder is either pulled by the wind or pulled by a boat. For conventional sandal type of bindings if the skier wants to jump in the air and do turns and twirls, this will be prevented since the board will come off the feet. So if the skier's foot is fixedly attached to the binding and that then interlocks with the board unconventional tricks may be performed without losing the boards.

The way this is conventionally done now is that the bindings or boot are affixed to the boards themselves and the user puts his foot in the boot and then affixes it with a strap or some other mechanism to lock the foot within the boot. The problem with this is that for the boarding trying to balance one's self when getting into boots which have to be relatively snug while the kite and board is moving requires extraordinary dexterity and is difficult to accomplish.

Similarly, for waveboarding, a person is trying to attach a boot fixedly to the foot while in the water prior to being pulled. While this is less difficult than kite boarding, it also requires extraordinary ingenuity to get the foot in the boot and the boots locked at the same time while dealing with a moving rope.

The additional water board embodiments described above utilize the quick release and quick lock mechanism between the board and the boot as described with snowboards above. The board has attached thereto a plate with a lockable flange similar to elements 160, 165 of FIG. 8 and the boot may have an insertable lip similar to 250, 265 of FIG. 8 to permit rotation between the boot and the board. The boot or binding may include magnets which match and align with magnets in the board so as to align these parts prior to rotation and locking. Thus, the board and boot do not become disengaged during intricate and forceful maneuvers with wave boards or kite boards.

In the embodiments relating to water sports a little more clearance between the lip and flange may be required because of the difference in attaching the boot or binding to the board in water and on the ground.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, and any combinations will be apparent to those of ordinary skill in the art without departing from the scope and spirit of the disclosure. The embodiment(s) were chosen and described in order to best explain the principles of the disclosure and the practical application, and to enable others of ordinary skill in the art to understand the disclosure for various embodiment(s) with various modifications and/or any combinations of embodiment(s) as are suited to the particular use contemplated.

Having thus described the disclosure of the present application in detail and by reference to embodiment(s) thereof, it will be apparent that modifications, variations, and any combinations of embodiment(s) are possible without departing from the scope of the disclosure defined in the appended claims.

The invention claimed is:

1. An apparatus for use with a board sport, comprising:

a first layer configured to attach to a surface and including a first magnet;

a second layer including a second magnet and configured to dock with the first layer; and a locking mechanism engaged by aligning the first magnet with the second magnet and rotating the second layer in a first direction, the locking mechanism preventing the second layer from undocking with the first layer, the locking mechanism disengaged by rotating the second layer in one of the first direction or a second direction.

2. The apparatus of claim 1 wherein the first layer includes at least a portion of a board base.

3. The apparatus of claim 1 wherein the surface includes at least a portion of a board.

4. The apparatus of claim 3 wherein the at least a portion of a board includes one of a snowboard, a kiteboard, and a wakeboard.

5. The apparatus of claim 1 wherein the second layer includes at least one of a binding base and a boot.

6. The apparatus of claim 1 wherein the second layer includes an intermediate adapter plate configured to fixably attach to one of a board base, a board deck, and a binding base.

7. The apparatus of claim 1 wherein the locking mechanism includes one or more lips and one or more shelves.

8. The apparatus of claim 1 wherein the locking mechanism includes at least one of one or more cams and one or more nubs.

9. An apparatus for use with a board sport, comprising:

a first layer configured to attach to a surface and including a first magnet;

a second layer including a second magnet and configured to dock with the first layer; and means for preventing the second layer from undocking from the first layer engaged by aligning the first magnet with the second magnet and rotating the second layer in a first direction, and allowing the second layer to undock from the first layer when rotated in one of the first direction or a second direction.

10. The apparatus of claim 9 wherein the first layer includes at least a portion of a board base.

11. The apparatus of claim 9 wherein the surface includes at least a portion of a board.

12. The apparatus of claim 11 wherein the at least a portion of a board includes one of a snowboard, a kiteboard, and a wakeboard.

13. The apparatus of claim 9 wherein the second layer includes at least one of a binding base and a boot.

14. The apparatus of claim 9 wherein the first layer includes an intermediate adapter plate configured to fixably attach to one of the first layer and the second layer.

15. The apparatus of claim 9 wherein the means for preventing includes a locking mechanism that includes one or more lips and one or more shelves.

16. The apparatus of claim 9 wherein the means for preventing includes a locking mechanism that includes at least one of one or more cams and one or more nubs.

* * * * *